United States Patent [19]

Ichinose et al.

[11] Patent Number: 4,830,882

[45] Date of Patent: May 16, 1989

[54] METHOD OF AND APPARATUS FOR CLEANING PAINT SPRAY GUNS

[75] Inventors: Kiyohiro Ichinose; Niichi Toyama; Tohru Yamamoto; Eiji Kikuchi; Masao Fukuda, all of Sayama, Japan

[73] Assignee: Honda Giken Kogyo Kabushiki Kaisha, Tokyo, Japan

[21] Appl. No.: 119,341

[22] Filed: Nov. 10, 1987

[30] Foreign Application Priority Data

| | | | |
|---|---|---|---|
| Nov. 10, 1986 | [JP] | Japan | 61-268226 |
| Nov. 10, 1986 | [JP] | Japan | 61-268227 |
| Nov. 10, 1986 | [JP] | Japan | 61-268228 |
| Nov. 10, 1986 | [JP] | Japan | 61-268229 |
| Nov. 10, 1986 | [JP] | Japan | 61-172826 |
| Nov. 10, 1986 | [JP] | Japan | 61-172827 |
| Nov. 10, 1986 | [JP] | Japan | 62-172828 |

[51] Int. Cl.[4] ..... B05D 1/02

[52] U.S. Cl. ..... 427/421; 118/300; 118/302; 118/323; 427/424

[58] Field of Search ..... 427/421, 424; 118/300, 118/302, 323; 239/106; 134/1

[56] References Cited

U.S. PATENT DOCUMENTS

| | | | |
|---|---|---|---|
| 2,899,929 | 8/1959 | Monroe | 118/302 |
| 3,073,529 | 1/1963 | Baker | 239/106 |
| 3,421,939 | 1/1969 | Jacke | 134/1 |
| 4,193,635 | 3/1980 | Thiruvengadam | 134/1 |
| 4,483,271 | 11/1984 | Eidschun | 118/302 |
| 4,721,630 | 1/1988 | Takeo | 427/421 |

*Primary Examiner*—Shrive Beck
*Assistant Examiner*—Vi Duong Dang
*Attorney, Agent, or Firm*—Birch, Stewart, Kolasch & Birch

[57] ABSTRACT

Paint spray guns are cleaned in respective cleaning tanks. In each of the cleaning tanks, a cleaning fluid is ejected to the nozzle end of the paint spray gun by a plurality of cleaning guns disposed in the cleaning tank. The paint spray guns and the cleaning tanks are relatively movable so that the cleaning tanks are retracted away when the paint spray guns spray a paint coat over a desired object such as a vehicle body. Each of the cleaning tanks includes two flexible cover members having holes for inserting the paint spray gun therethrough. The cover members and the inserted paint spray gun close a cleaning chamber defined in the cleaning tank to prevent the cleaning fluid from leaking out. Each cleaning tank comprises a base plate and a casing detachably mounted on the base plate and defining the cleaning chamber. Nozzles or an annular pipe is mounted on and outside of each cleaning tank for ejecting air under pressure to the paint spray gun which has been displaced out of the cleaning tank, thereby to dry any remaining cleaning solution on the paint spray gun. Pipes for supplying paint to the paint spray guns are also cleaned by air under pressure and a solvent which are introduced into the pipes to produce air bubbles for removing paint deposits from within the pipes.

27 Claims, 16 Drawing Sheets

METHOD OF AND APPARATUS FOR CLEANING PAINT SPRAY GUNS

BACKGROUND OF THE INVENTION

The present invention relates a method of and an apparatus for cleaning a plurality of paint spray guns by placing the paint spray guns in a cleaning tank with a plurality of cleaning nozzles disposed therein, and ejecting a solvent such as a thinner from the cleaning nozzles to clean the paint spray guns and the interiors of pipes which supply paint to the paint spray guns, for thereby cleaning the paint spray guns efficiently and automatically within a short period of time so that the painting process is easily automatized.

Automobile industry generally employs a painting apparatus for applying paint coating to the outer panels of automobile bodies. The painting apparatus is automatized in order to meet the assembling process of a line production system. In general, the painting apparatus comprises a plurality of paint spray guns. While the paint spra guns and an automobile body to be painted are being relatively moved, paint is sprayed from the paint spray guns to automatically apply a paint coat on the automobile body.

As paint of one color is coated on successive automobile bodies, the paint which is ejected from one paint spray gun is apt to be deposited on the tip end or nozzle of the paint spray gun. When a paint coat of another color is subsequently applied from the same paint spray gun, the deposited paint on the nozzle of that paint spray gun mixes or chemically reacts with the ejected paint, and the paint mixture or reaction product is solidified and cloggs the nozzle, with the result that paint may not be sprayed from the paint spray gun in a subsequent paint spraying process.

Heretofore, it has been customary, before and after a painting process is carried out, for the worker to wash the nozzles of paint spray guns with a solvent such as a thinner applied to a brush and then wipe any solvent off the nozzles with a piece of cloth thereby to clean the paint spray guns.

Since the paint spray guns are manually cleaned by the worker, the cleaning process is quite timeconsuming and imposes a heavy burden on the worker especially when cleaning an automatic painting apparatus having many paint spray guns. Intervention by the worker for the cleaning process makes it difficult to achieve an automatized painting process.

Various cleaning apparatus have been proposed for automatically cleaning paint spray guns. These proposed cleaning apparatus basically have a plurality of cleaning nozzles disposed in a casing. In operation, a paint spray gun to be cleaned is placed in the casing, and a solvent such as a thinner is ejected from the cleaning nozzles to blow or dissolve away a paint deposit on the nozzle of the paint spray gun.

The conventional cleaning apparatus are effective in cleaning a single paint spray gun as mounted on a robot apparatus or the like. However, they fail to clean a painting apparatus having plurality of paint spray guns within a short period of time. Therefore, the earlier cleaning apparatus are unable to accomplish an efficient process of painting automobile bodies.

The paint spray guns generally have a paint spray nozzle projecting toward a body. In a painting process, a relatively large amount of paint tends to remain attached to the boundary between the nozzle and the body and in the vicinity of the ejection hole of the nozzle. When such a paint spray gun with locally different amounts of paint deposited thereon is cleaned by the conventional cleaning apparatus, a considerable quantity of solvent should be ejected to the paint spray gun in order to completely remove the paint deposit at the boundary between the nozzle and the body and the paint deposit in the vicinity of the ejection hole of the nozzle. This is not economical since an excessive amount of solvent is applied to the body and other portions where the paint deposit is comparatively small in quantity.

In the cleaning apparatus of the type described above, a mist containing a large amount of thinner is likely to leak out between the casing and the paint spray gun being cleaned. Consequently, the thinner is scattered around in the working area and may be inhaled by the workers, thus causing a serious problem as to the health of the workers.

After a painting process is completed by the painting apparatus, the paint remains deposited in a pipe which supplies the paint to the paint spray gun. The paint in the pipe is solidified into a clog which may prevent paint from being supplied to the paint spray gun in a subsequent painting process. In automobile assembling plants, automobiles of different colors are assembled at the same time, and different paint coats are applied by the painting apparatus to different automobile bodies. When paint of one color is replaced with paint of another color in the painting apparatus, if a certain amount of the previous paint remains in the pipe connected to the spray gun after a painting process has been finished, the new paint mixes with the previous paint remaining in the pipe. This is highly disadvantageous in that paint of desired color cannot be coated on an automobile body.

SUMMARY OF THE INVENTION

It is a general object of the present invention to provide a method of and an apparatus for cleaning a plurality of paint spray guns efficently and automatically to allow the paint spray guns to paint an object automatically in a reduced period of time.

It is a primary object of the present invention to provide a method of automatically cleaning paint spray guns of a painting apparatus having an upper painting mechanism for painting an upper portion of an object fed along a painting line and a side painting mechanism for painting a side of the object, the method comprising the steps of displacing cleaning tanks for cleaning a plurality of paint spray guns of at least one of the painting mechanisms from a standby position to a cleaning position, each of the cleaning tanks having a plurality of cleaning nozzles therein, relatively moving the cleaning tanks and the one painting mechanism to bring the paint spray guns into the cleaning tanks, and ejecting a cleaning fluid from the cleaning nozzles to clean the paint spray guns in the cleaning tanks.

Another object of the present invention is to provide a method wherein the one painting mechanism is the upper painting mechanism.

Yet another object of the present invention is to provide a method wherein side paint spray guns on the side painting mechanism are directed horizontally and the cleaning tanks for cleaning the side paint spray guns and the side painting mechanism are caused to confront each other, thereafter the side paint spray guns are brought into the cleaning tanks, and then a cleaning solution is ejected from the cleaning nozzles to clean the side paint spray guns.

Still another object of the present invention is to provide an apparatus for cleaning paint spray guns, comprising a first cleaning mechanism for cleaning a plurality of paint spray guns mounted on an upper painting mechanism for cleaning an upper portion of an object, a second cleaning mechanism for cleaning a plurality of paint spray guns mounted on a side painting mechanism for cleaning a side of the object, each of the first and second cleaning mechanisms having as many cleaning tanks as the number of the paint spray guns and a plurality of cleaning nozzles in each of the cleaning tanks for ejecting a cleaning fluid, and the cleaning tanks of at least the first cleaning mechanism being displaceable between a standby position and a cleaning position, and retractable to the standby position to prevent the cleaning mechanism from interfering with the painting operation when the object is painted by the painting mechanisms.

A still further object of the present invention is to provide an apparatus wherein the cleaning tanks of the first cleaning mechanism are displaceable between the standby position which is parallel to a direction in which the object is painted and the cleaning position which is normal to the direction and confronts the paint spray guns of the upper painting mechanism.

A yet still further object of the present invention is to provide an apparatus wherein the cleaning tanks of the first cleaning mechanism are vertically movable in unison.

A further object of the present invention is to provide an apparatus wherein at least one of the cleaning tanks of the second cleaning mechanism is displaceable by an actuator in a direction normal to a direction in which the object is painted, the cleaning tanks being positionally adjustable so that the paint spray guns of the side painting mechanism confront the cleaning tanks when the side painting mechanism is angularly displaced to confront the second cleaning mechanism.

A yet further object of the present invention is to provide an apparatus further including a separation tank connected to the cleaning tanks for separating a drain and a mist which are produced in the cleaning tanks.

Another object of the present invention is to provide an apparatus for cleaning a nozzle end of a paint spray gun, comprising a cleaning tank for receiving the nozzle end therein, a plurality of cleaning nozzles disposed in the cleaning tank for ejecting a cleaning fluid to clean the nozzle end therein, the cleaning tank including at least two flexible cover members for accommodating the nozzle end of the paint spray gun, each of the flexible cover members having a hole smaller in diameter than a portion of the paint spray gun which enters the cleaning tank, and a plurality of angularly spaced slits extending radially outwardly and communicating with the hole, the flexible cover members being held against each other with the slits not overlapping each other, and whereby when the paint spray gun is inserted into the holes, the paint spray gun and the cover members separate the interior and exterior of the cleaning tank from each other to prevent the cleaning fluid ejected by the cleaning nozzles from leaking out of the cleaning tank.

Still another object of the present invention is to provide an apparatus wherein the cover members are made of a resin material which is resistant to erosion by the cleaning fluid.

Yet another object of the present invention is to provide an apparatus for cleaning a nozzle end of a paint spray gun, comprising a cleaning tank for receiving the nozzle end therein, a plurality of cleaning nozzles disposed in the cleaning tank for ejecting a cleaning fluid to clean the nozzle end therein, the cleaning tank including a base plate and a casing detachably mounted on the base plate and defining a cleaning chamber therein, the cleaning nozzles being supported on the base plate, and pipes extending through the base plate for supplying the cleaning fluid to the cleaning nozzles.

It is also an object of the present invention to provide an apparatus wherein the cleaning tank further includes a flexible cover member attached to the base plate and having a hole for inserting the paint spray gun therein, whereby when the paint spray gun is inserted through the hole into the cleaning tank, the cover member and the paint spray gun isolates the cleaning chamber from the exterior of the cleaning tank, the casing having a passage for leading a drain and a mist produced in the cleaning chamber to a processing unit.

A further object of the present invention is to provide an apparatus for cleaning a nozzle end of a paint spray gun, comprising a cleaning tank for receiving at least the nozzle end therein, a plurality of cleaning nozzles disposed in the cleaning tank for ejecting a cleaning fluid to clean the nozzle end therein, and the cleaning nozzle having a first passage for supplying a solvent and a second passage for supplying air, the cleaning nozzle being arranged to mix the solvent and air supplied from the first and second passages in a position just out of the cleaning nozzle and to eject the mixture as the cleaning fluid to the nozzle end of the paint spray gun.

A yet further object of the present invention is to provide an apparatus wherein the cleaning nozzle includes a first nozzle for ejecting the solvent supplied from the first passage and a second nozzle disposed coaxially around the first nozzle for ejecting the air supplied from the second passage, whereby the mixture of the solvent ejected from the first nozzle and the air ejected from the second nozzle is applied to the nozzle end of the paint spray gun to clean the nozzle end.

A yet still further object of the present invention is to provide an apparatus wherein the cleaning nozzle is made of stainless steel.

Another object of the present invention is to provide a method of cleaning a paint spray gun, comprising the steps of inserting the paint spray gun in a cleaning tank housing a plurality of cleaning nozzles therein, ejecting a solvent from the cleaning nozzles to clean the paint spray gun in the cleaning tank, then, relatively displacing the paint spray gun and the cleaning tank away from each other, and thereafter, ejecting a fluid under pressure from the fluid ejecting means mounted on and outside of the cleaning tank to dry the paint spray gun.

Still another object of the present invention is to provide an apparatus for cleaning a nozzle end of a paint spray gun, comprising a cleaning tank for receiving at least the nozzle end therein, a plurality of cleaning nozzles disposed in the cleaning tank for ejecting a solvent to the nozzle end to clean the nozzle end in the cleaning tank, and fluid ejecting means mounted on and outside of the cleaning tank for ejecting a fluid under pressure to the nozzle end to dry the nozzle end.

Yet another object of the present invention is to provide an apparatus wherein the cleaning tank comprises a base plate and a casing, the base plate and the casing jointly defining a cleaning chamber therebetween, the cleaning nozzles being supported on a surface of the base plate which defines the cleaning chamber, the fluid ejecting means being mounted on the opposite surface of the base plate.

A further object of the present invention is to provide an apparatus wherein the fluid ejecting means comprises a plurality of nozzles disposed around and directed toward the nozzle end of the paint spray gun for ejecting air as the fluid to the nozzle end of the paint spray gun.

A yet further object of the present invention is to provide an apparatus wherein the fluid ejecting means comprises an annular tube having a plurality of holes defined in an inner peripheral surface thereof for ejecting therethrough air as the fluid to the nozzle end of the paint spray gun.

A still further object of the present invention is to provide an apparatus further including a substantially cylindrical cover member disposed between the base plate and the annular tube.

A yet still further object of the present invention is to provide an apparatus for cleaning a paint spray gun, comprising a cleaning tank for receiving the paint spray gun, a plurality of cleaning guns disposed in the cleaning tank and having nozzles for ejecting a cleaning fluid in different spraying patterns, and the cleaning guns being selectively actuated for cleaning the paint spray guns dependent on the shape or an area to be cleaned of the paint spray gun which is received in the cleaning tank.

Another object of the present invention is to provide an apparatus wherein the spraying patterns include at least a circular pattern, an annular pattern, and a slit-like pattern.

Yet another object of the present invention is to provide an apparatus wherein the cleaning fluid comprises a mixture of air and a thinner.

Still another object of the present invention is to provide a method of cleaning an interior of a pipe connected to a paint spray gun of a painting apparatus for supplying paint to the paint spray gun, comprising the steps of introducing air under pressure into the pipe, and then passing a cleaning solvent through the pipe during a prescribed period of time while the air is being introduced under pressure in the pipe for cleaning the interior of the pipe with a mixture of the solvent and the air under pressure.

Yet still another object of the present invention is to provide a method wherein the air under pressure and the solvent are supplied to the pipe in response to switching operation of a valve mechanism, the pressure of the solvent being higher than the pressure of the air.

A further object of the present invention is to provide a method wherein the cleaning solvent to be mixed with the air under pressure is passed through the air to produce air bubbles in the cleaning solvent, whereby the interior of the pipe is cleaned by impact forces applied when the air bubbles are broken.

The above and other objects, features and advantages of the present invention will become more apparent from the following description when taken in conjunction with the accompanying drawings in which preferred embodiments of the present invention are shown by way of illustrative example.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
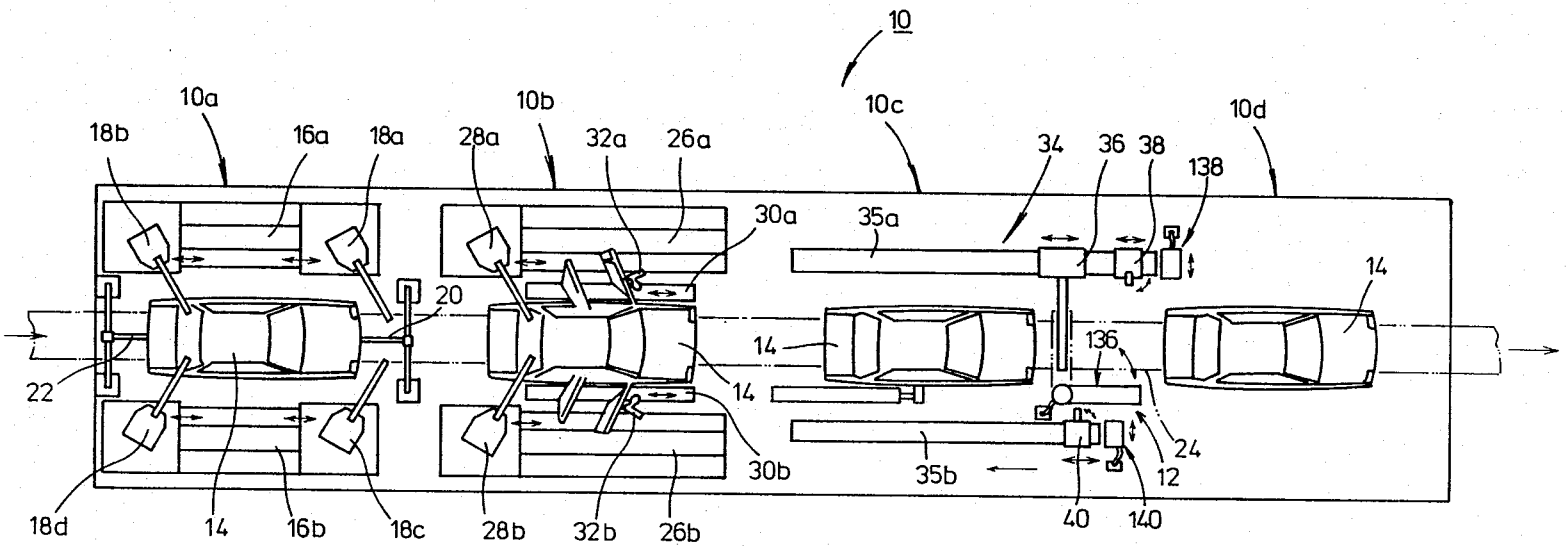
FIG. 1 is a plan view of a painting line system incorporating a cleaning apparatus according to the present invention.

FIG. 1 shows an automobile painting line system 10 which is divided into a first stage 10*a*, a second stage 10*b*, a third stage 10*c*, and a fourth stage 10*d*. A cleaning apparatus 12 according to the present invention is disposed in the third stage 10*c*.

In the first stage 10*a*, the engine compartment and trunk compartment of each of vehicle bodies 14 are painted. The first stage 10*a* includes painting robots 18*a* through 18*d* movably mounted on rails 16*a*, 16*b* disposed on opposite sides of the first stage 10*a*. The first stage 10*a* also includes an engine hood opening/closing mechanism 20 and a trunk lid opening/closing mechanism 22. The painting line system 10 includes a vehicle body conveyor mechanism 24 extending centrally from the first to fourth stages 10*a* through 10*d*.

In the second stage 10*b*, the inner surfaces of doors of each vehicle or automobile body 14 are painted. The second stage 10*b* includes painting robots 28*a*, 28*b* movably mounted respectively on rails 26a, 26b disposed on opposite sides of the second stage 10b. Additional rails 30a, 30b are disposed between the vehicle body conveyor mechanism 24 and the rails 26a, 26b, and door opening/closing mechanisms 32a, 32b are movably mounted on the rails 30a, 30b, respectively.

In the third stage 10c with the cleaning apparatus 12 incorporated therein, the outer panels including the engine hood, trunk lid, roof, and doors of each vehicle body 14 are painted by a painting apparatus 34 in the third stage 10c. In the fourth stage 10d, the painted vehicle body 14 is dried. In the first through third stages 10a–10c, the electrostatic painting process is employed in which the paint is electrostatically applied to the vehicle bodies.

Figure 2:
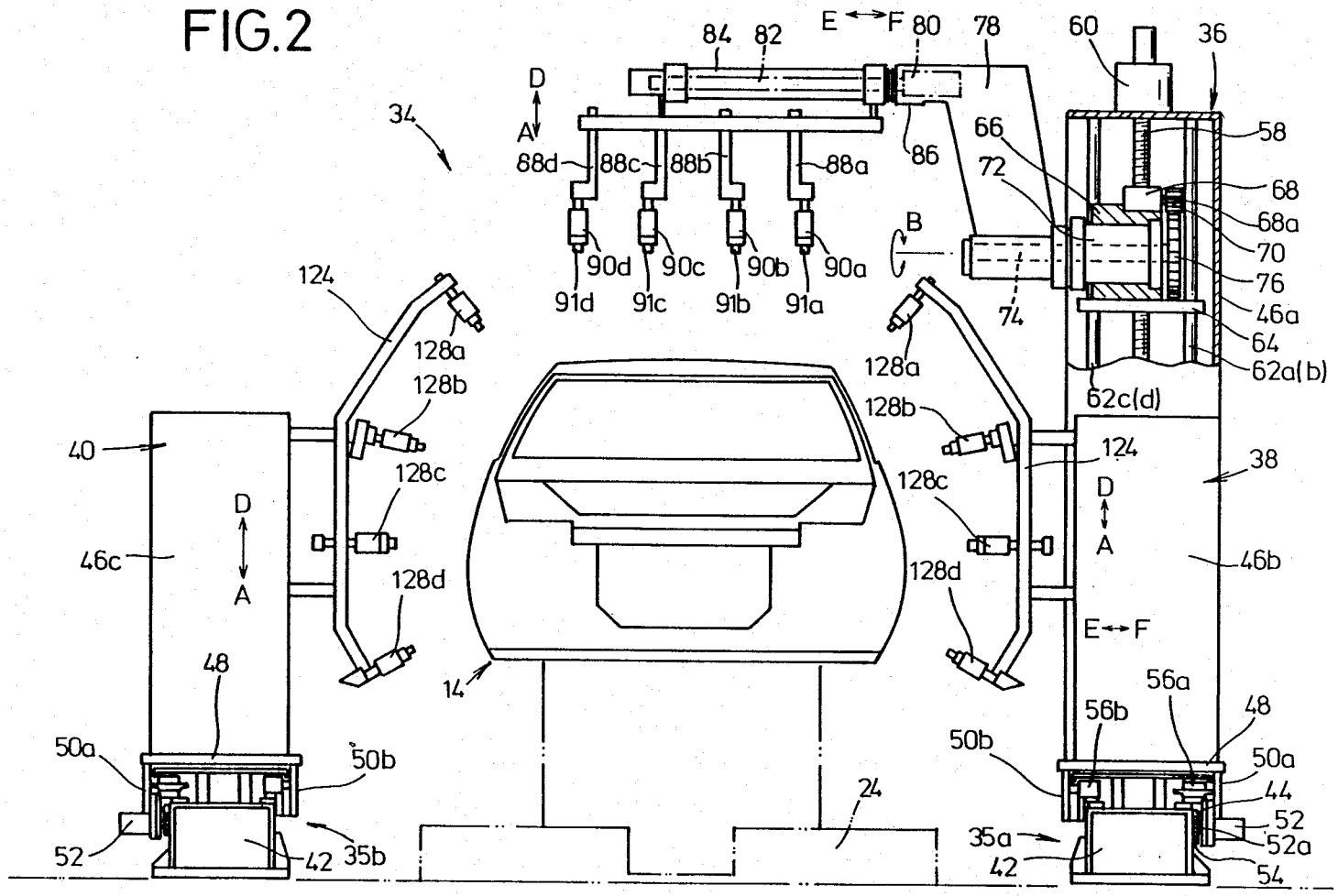
FIG. 2 is a front elevational view, partly in cross section, of a painting apparatus to be cleaned by the cleaning apparatus of the invention.

As shown in FIGS. 1 and 2, the painting apparatus 34 basically comprises rails 35a, 35b disposed parallel to each other on the opposite sides of the vehicle body conveyor mechanism 24, an upper painting mechanism 36 and a lefthand side painting mechanism 38 which are movable along the rail 35a, and a righthand side painting mechanism 40 movable along the rail 35b.

In the third stage 10c, the upper painting mechanism 36, the lefthand side painting mechanism 38, and the righthand side painting mechanism 40 are moved along the rails 35a, 35b by transport means which are of essentially the same design. More specifically, as shown in FIG. 2, each of the rails 35a, 35b is constituted by a rail bracket 42 extending from one end to the other of the rails 34a, 34b. To a vertical outer side of the rail bracket 42, there is attached a rack 44 extending longitudinally along the rail bracket 42.

The upper, lefthand and righthand side painting mechanisms 36, 38, 40 have outer frames comprising casings 46a through 46c with a plate 48 secured to the lower end thereof. Side plates 50a, 50b are vertically affixed to the opposite edges of the lower surface of the plate 48. A transport motor 52 is fixed to each of the side plates 50a. The transport motor 52 has a rotatable shaft 52a supporting on its distal end a pinion 54 meshing with the rack 44 fixed to the rail bracket 42. Roller assemblies 56a, 56b are mounted on the side plates 50a, 50b, respectively, in rolling engagement with the rail bracket 42.

The upper painting mechanism 36 will be described below. As shown in FIG. 2, a vertical ball screw 58 is rotatably supported in the casing 46a and has an upper end coupled to the drive shaft of a lifting/lowering motor 60 mounted on the upper surface of the casing 46a. Four guide rods 62a through 62d are disposed vertically parallel to each other around the ball screw 58. A horizontal support plate 64 is threadedly disposed around and held in mesh with the ball screw 58 and can be moved upwardly and downwardly by rotating the ball screw 58 about its own axis upon energization of the lifting/lowering motor 60. The guide rods 62a–62d extend through the support plate 64.

A turning motor 68 is fixed to the upper surface of the support plate 64 via a holder 66. The turning motor 68 has a rotatable shaft 68a on which a gear 70 is mounted. The holder 66 holds therein a bearing 72 supporting a turning shaft 74 having one end on which is mounted a gear 76 meshing with the gear 70. The other end of the turning shaft 72 projects out of the casing 46a, and one end of a swing arm 78 is secured to the projecting end of the turning shaft 74.

A shifting cylinder 80 is disposed as a shifting means on the other end of the swing arm 78. The shifting cylinder 80 has a piston rod 82 extending in and engaging a slide sleeve 84 to which a horizontal gun arm 86 is connected. Gun support bars 88a through 88d spaced at intervals are supported on the horizontal gun arm 86 perpendicularly thereto. Paint spray guns 90a through 90d are supported as paint spraying means on the lower ends of the gun support bars 88a through 88d, respectively, the paint spray guns 90a through 90d being thus spaced from each other. The paint spray guns 90a through 90d have respective nozzles 91a through 91d on their tip ends.

The lefthand and righthand side painting mechanisms 38, 40 serve to paint the lefthand and righthand sides, respectively, of the vehicle body 14, and are of basically the same construction. Therefore, only the lefthand side painting mechanism 38 will be described in detail below.

Figure 3:
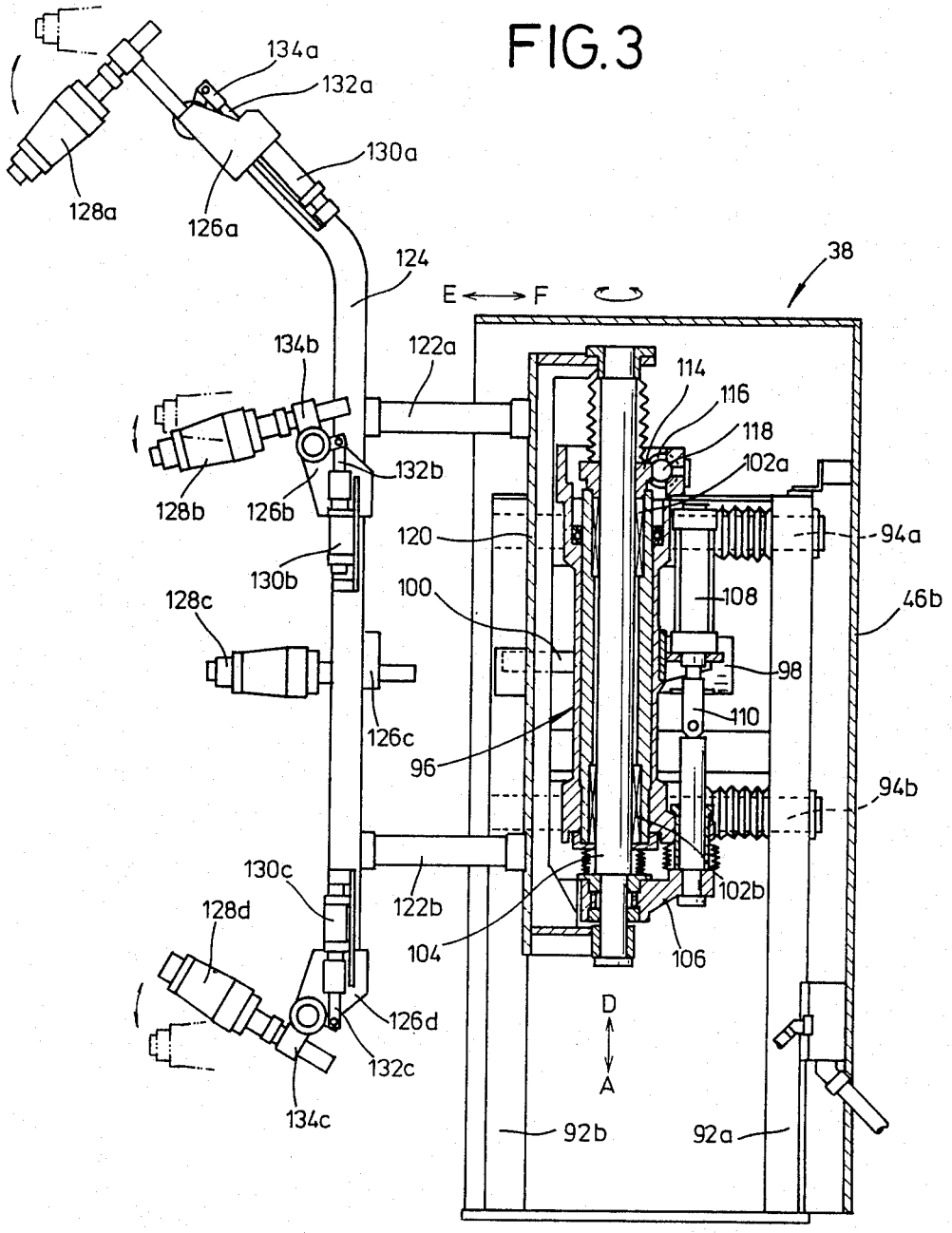
FIG. 3 is a vertical cross-sectional view of a side painting mechanism of the painting apparatus.

As illustrated in FIG. 3, vertical posts 92a, 92b are disposed in the casing 46b of the lefthand side painting mechanism 38. Two guide bars 94a, 94b extend horizontally between and are connected to the posts 94a, 94b in perpendicular relation to the rails 35a, 35b, and a holder 96 is slidably mounted on the guide bars 94a, 94b. A horizontally moving cylinder 98 is fixed to the holder 96 and has a piston rod (not shown) with its distal end connected to the post 92b through a joint 100.

A guide bar 104 extends vertically through and is slidably and rotatably supported in the holder 96 by means of slide bearings 102a, 102b. A joint 106 is attached to the lower end of the guide bar 104 which projects below the holder 96. A shifting cylinder 108 is fixed to the outer periphery of the holder 96 and has a downwardly extending piston rod 110 coupled to the joint 106. A pinion 114 is mounted on an upper portion of the guide bar 104, and a rack 118 extending from a cylinder 116 mounted on the holder 96 is held in mesh with the pinion 114.

A holder 120 is coupled to the guide bar 104 at its upper and lower ends. A gun arm 124 is supported on the holder 120 through support members 122a, 122b. To the gun arm 124, there are attached paint spray guns 128a through 128d as paint spraying means by means of joints 126a through 126d, respectively, the paint spray guns 128a through 128d being spaced from each other. The paint spray guns 128a, 128b, and 128d are swingable. More specifically, cylinders 130a through 130c are mounted on the gun arm 124 and have respective piston rods 132a through 132c to which respective ends of holder members 134a through 134c are coupled. The holder members 134a through 134c are angularly movably supported respectively on the joints 126a, 126b, and 126d. The paint spray guns 128a, 128b, and 128d are munted respectively on the other ends of the holders 134a through 134c. The paint spray gun 128c is fixed in position such that its tip end is directed horizontally.

The cleaning apparatus 12 according to the present invention will be described in detail below.

Figure 4:
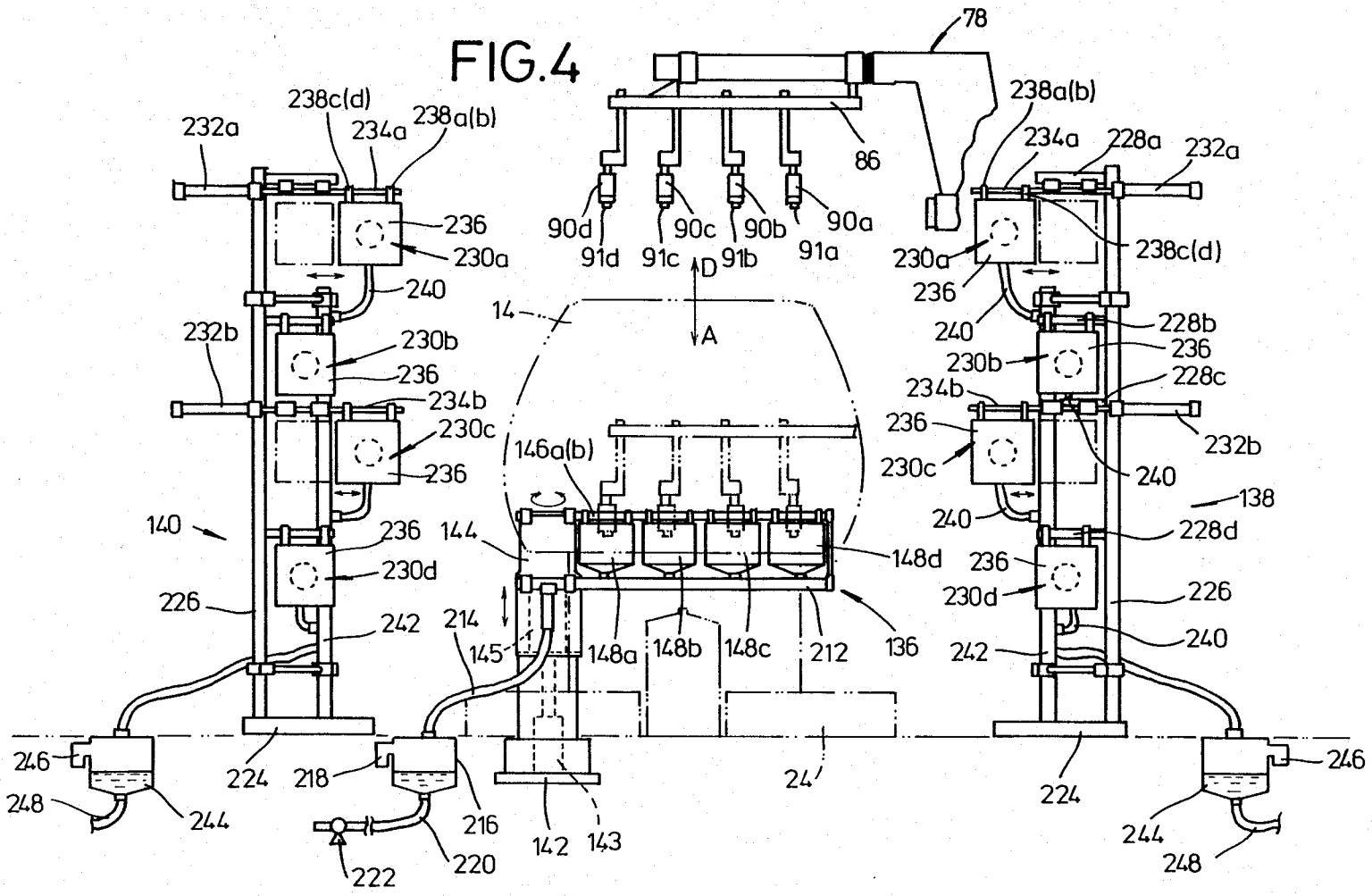
FIG. 4 is front elevational view showing the manner in which the cleaning apparatus of the invention is arranged.

As shown in FIGS. 1 and 4, the cleaning apparatus 12 basically includes an upper paint spray gun cleaning mechanism 136 for cleaning the paint spray guns 90a through 90d, and side paint spray gun cleaning mechanisms 138, 140 for cleaning the paint spray guns 128a through 128d of the lefthand and righthand side painting mechanisms 38, 40.

In FIG. 4, the upper paint spray gun cleaning mechanism 136 includes a base 142 and a body 144 vertically movably and swingably mounted on the base 142. The body 144 is vertically movable by a cylinder 143 fixedly mounted in the base 142 and swingable by a rotatable drive source 145 in the base 142. The body 144 may be vertically movable by a rack-and-pinion mechanism, a ball screw mechanism, or the like rather than the cylinder 143, and may be swingable by any of various other mechanisms than the rotative drive source 145.

Support rods 146*a*, 146*b* have one end attached to an upper portion of the body 144 and extend horizontally parallel to each other. The support rods 146*a*, 146*b* support thereon cleaning tanks 148*a* through 148*d* which are spaced from each other in vertical alignment with the paint spray guns 90*a* through 90*d*, respectively, of the upper painting mechanism 36.

Since the cleaning tanks 148*a* through 148*d* are of the same construction, only the cleaning tank 148*a* will be described below in detail and the other cleaning tanks 148*b* through 148*d* will not be described.

Figure 5:
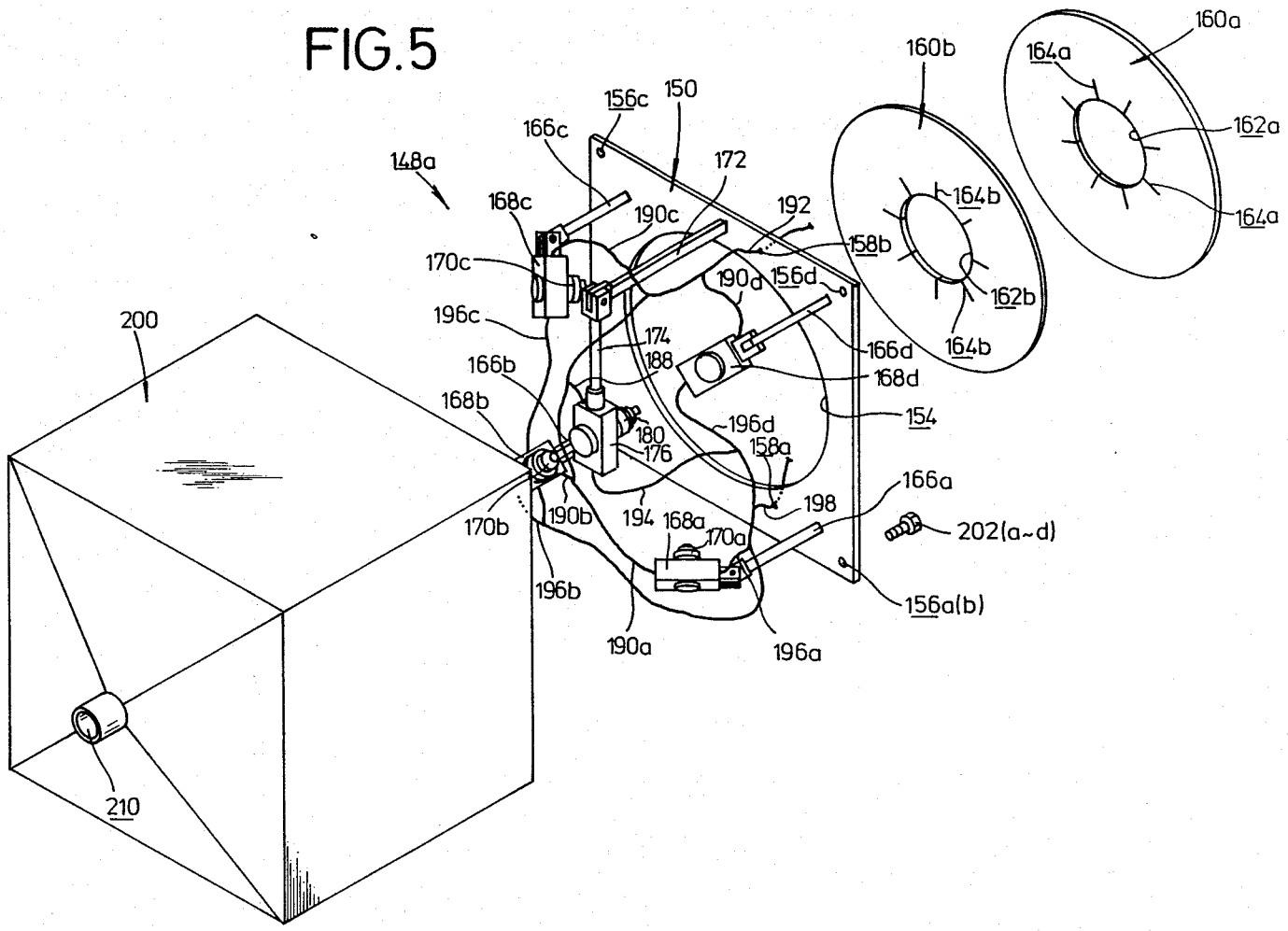
FIG. 5 is an exploded perspective view of a cleaning tank of the cleaning apparatus of the invention.
Figure 6:
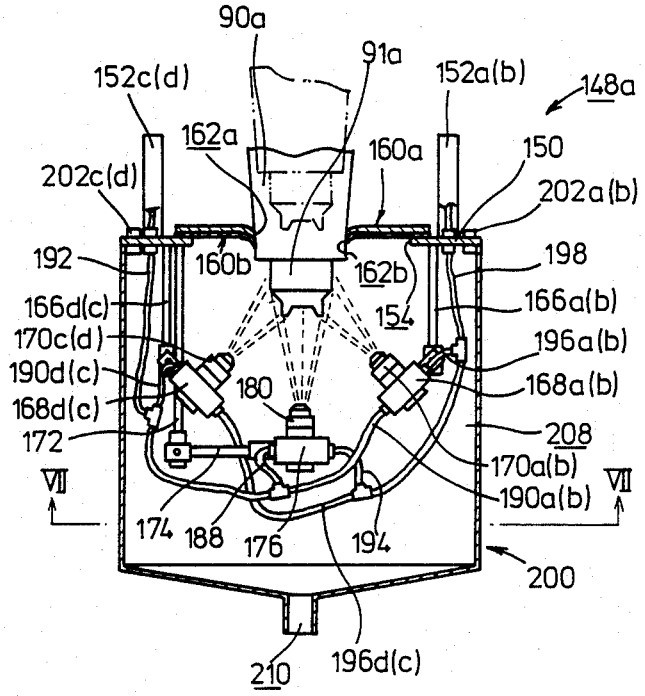
FIG. 6 is a vertical cross-sectional view of the cleaning tank shown in FIG. 5.
Figure 7:
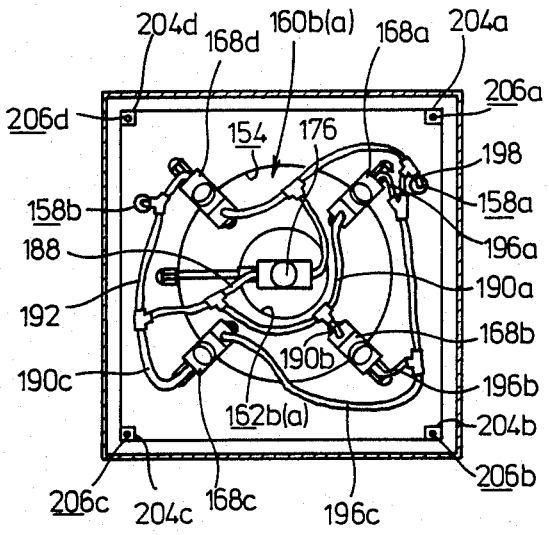
FIG. 7 is a cross-sectional view taken along line VII—VII of FIG. 6.

As shown in FIGS. 5 through 7, the cleaning tank 148*a* has a base plate 150 having support members 152*a* through 152*b* engaging the support rods 146*a*, 146*b* from which the cleaning tank 148*a* is suspended. The base plate 150 has a relatively large circular opening 154 defined centrally therein. The base plate 150 also has bolt insertion holes 156*a* through 156*d* defined respectively at the corners thereof, and pipe insertion holes 158*a*, 158*b* defined therein.

Flexible cover members 160*a*, 160*b* are fixed to the base plate 150 over the opening 154. The cover members 160*a*, 160*b* are preferably made of a resin material such as polytetrafluoroethylene or the like and are of the same shape. The flexible cover members 160*a*, 160*b* are relatively thin, being of a thickness of about 1 mm, and have central holes 162*a*, 162*b*, respectively, which are of a diameter smaller than that of the nozzles 91*a* through 91*d* of the paint spray guns 90*a* through 90*d*. The cover members 160*a*, 160*b* have slits 164*a*, 164*b* extending radially outwardly from the centers of the holes 162*a*, 162*b* and spaced from each other. The flexible cover members 160*a*, 160*b* are place one on the other and fixed to the base plate 150 with the slits 164*a*, 164*b* not overlapping each other.

A shown in FIG. 5, support bars 166*a* through 166*d* each have one ends secured to the surface of the base plate 150 remote from the support members 152*a* through 152*d*, the support bars 166*a* through 166*d* surrounding the opening 154 and being equidistantly spaced from each other. Cleaning guns 168*a* through 168*d* are mounted respectively on the other ends of the support bars 166*a* through 166*d*, respectively. The cleaning guns 168*a* through 168*d* have nozzle ends 170*a* through 170*d* of stainless steel inclined toward the base plate 150 and directed to the central axis of the opening 154. A support bar 172 is disposed between the support bars 166*c*, 166*d*, and another support bar 174 is coupled perpendicularly to the distal end of the support bar 172. A cleaning gun 176 is mounted on support bar 174.

Figure 8:
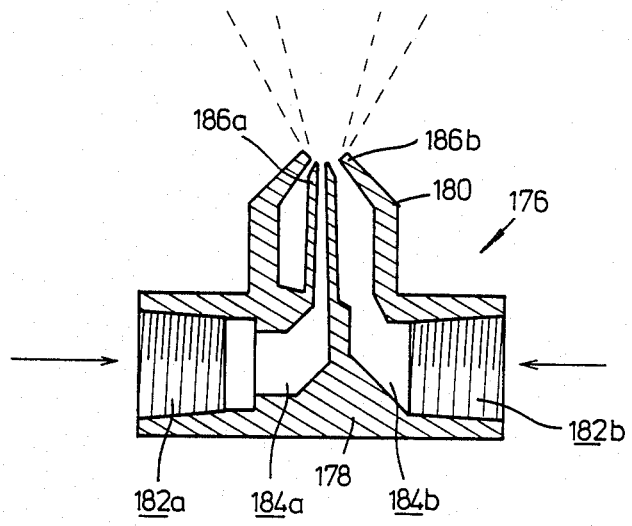
FIG. 8 is a vertical cross-sectional view of a cleaning gun in the cleaning apparatus.

As shown in FIG. 8, the cleaning gun 176 comprises a rectangular body 178 and a nozzle end 180 of stainless steel extending outwardly from an intermediate portion of the body 178. The body 178 has a first port 182*a* defined in one end thereof for supplying a solvent and a second port 182*b* defined in the opposite end for supplying air, the first and second ports 182*a*, 182*b* communicating with first and second passages 184*a*, 184*b*, respectively. The nozzle end 180 has a first nozzle 186*a* and a second nozzle 186*b* disposed coaxially with and surrounding the first nozzle 186*a*. The first nozzle 186*a* communicates with the first passage 184*a*, and the second nozzle 186*b* communicates with the second passage 184*b*.

The other cleaning guns 168*a* through 186*d* are of the same construction as that of the cleaning gun 176, and will not be described in detail.

The first port 182*a* of the cleaning gun 176 and non-illustrated ports of the cleaning guns 168*a* through 168*d* are connected to ends of first pipes 188, 190*a* through 190*d*. The other ends of the first pipes 188, 190*a* through 190*d* are connected to a pipe 192 inserted through the hole 158*b* of the base plate 150 and connected to a solvent source (not shown). The second port 182*b* of the cleaning gun 176 and other non-illustrated ports of the cleaning guns 168*a* through 168*d* are connected to ends of second pipes 194, 196*a* through 196*d*, the other ends of which are connected to a pipe 198 inserted through the hole 158*a* of the base plate 150 and connected to an air source (not shown).

A casing 200 is detachably mounted on the base plate 150 by means of bolts 202*a* through 202*d*. Attachment members 202*a* through 222*d* project inwardly from one end of the casing 200 and have threaded holes 206*a* through 206*d* (FIG. 7), respectively, coaxial with the holes 156*a* through 156*d* of the base plate 150. The casing 200 defines therein a cleaning chamber 208 held in communication, through the lower end of the casing 200, with a small-diameter drain/mist outlet 210.

In FIG. 4, a conduit 212 is connected to the outlets 210 of the cleaning tanks 148*a* through 148*d*, and attached to the body 144 for vertical and turning movement in unison therewit. To the conduit 212, there is connected one end of a flexible conduit 214 with its other end coupled to a separation tank 216. The separation tank 216 has a mist conduit 218 on its upper portion and is connected at its lower portion to a drain conduit 220 which is connected to a pump 222, for example, that is coupled to a drain processing unit (not shown).

The side paint spray gun cleaning mechanisms 138, 140 are structurally identical to each other. Therefore, only the side paint spray gun cleaning mechanism 138 will be described below in detail.

The cleaning mechanism 138 includes a base 224 on which a post 226 is vertically mounted. The post 226 has holders 228*a* through 228*d* extending horizontally at different heights. Cleaning tanks 230*a* through 230*d* are supported on the holders 228*a* through 228*d*, respectively, in horizontal alignment with the respective paint spray guns 128*a* through 128*d* of the lefthand side painting mechanism 38. The cleaning tanks 230*b*, 230*d* are fixed to the holders 228*b*, 228*d*, respectively, whereas the other cleaning tanks 230*a*, 230*c* are horizontally displaceable. More specifically, cleaning tank shifting cylinders 232*a*, 232*b* are horizontally mounted on the post 206 in vertically spaced relation to each other, and have respective piston rods 234*a*, 234*b* extending horizontally and coupled to the cleaning tanks 230*a*, 230*c*, respectively.

The cleaning tanks 230*a* through 230*d* are structurally substantially the same as the cleaning tank 148*a*. The cleaning tanks 230*a* through 230*d* have casings 236 on which there are mounted support members 238*a* through 238*d* by which the cleaning tanks 230*a* through 230*d* are suspended from the holders 228*b*, 228*d* and the piston rods 234*a*, 234*b*. The internal structures of the cleaning tanks 230*a* through 230*d* are the same as that of the cleaning tank 148*a*, and hence will not be described in detail.

The casings 236 of the cleaning tanks 230*a* mist conduits 240 that are coupled via a conduit 242 to a separation tank 244 which has a mist conduit 246 and is joined to a drain conduit 248.

The cleaning apparatus for carrying out a cleaning method of the invention is basically structured as described above. Operation and advantages of the cleaning apparatus are as follows:

A vehicle body 14 which has been delivered to the first stage 10*a* by the conveyor mechanism 24 is first accessed by the engine hood opening/closing mechanism 20, which opens the engine hood, and by the trunk lid opening/closing mechanism 22, which opens the trunk lid. The engine compartment and the trunk compartment are then painted by the painting robots 18*a* through 18*d* which run along the rails 16*a*, 16*b*. Thereafter, the engine hood and the trunk lid are closed by the respective opening/closing mechanisms 20, 22, and then the vehicle body 14 is conveyed to the second stage 10*b* by the conveyor mechanism 24.

In the second stage 10*b*, the doors of the vehicle body 14 are opened by the door opening/closing mechanisms 32*a*, 32*b*, add the inner surfaces of the opened doors are painted by the painting robots 28*a*, 28*b* which travel along the rails 26*a*, 26*b*. The doors are thereafter closed by the door opening/closing mechanisms 32*a*, 32*b*, and the vehicle body 14 is fed to the third stage 10*c* by the conveyor mechanism 24.

The paint spray guns 90*a* through 90*d* mounted by the upper painting mechanism 36 are oriented toward the front panel of the vehicle body 14, and the paint spray guns 128*a*, 128*b*, 128*d* mounted on the side painting mechanisms 38, 40 are positioned complementarily to the side panels of the vehicle body 14 by being angularly displaced by the cylinders 130*a*, 130*c*. The transport motor 52 is energized to rotate the pinion 54 mounted on the rotatable shaft 52*a* of the transport motor 52 to cause the upper painting mechanism 36 to start running with the roller assemblies 56*a*, 56*b* along the rail bracket 42 in the direction of the arrow C (see FIG. 1).

When the spacing between the front panel of the vehicle body 14 and the paint spray guns 90*a* through 90*d* of the upper painting mechanism 36 reaches a prescribed distance, the transport motor 52 is de-energized or decelerated to a prescribed rotational speed. The lifting/lowering motor 60 is then energized to rotate the ball screw 58 coupled to the motor 60 to cause the support plate 64 meshing with the ball screw 58 to start lifting the swing arm 782 in the direction of the arrow D. Paint sprays are ejected from the paint spray guns 90*a* through 90*d* toward the front panel of the vehicle body 14 to paint the front panel.

The paint spray guns 90*a* through 90*d* are spaced at intervals so as to prevent the ejected paint sprays from interfering with each other. Therefore, the surface of the front panel of the automobile body 14 is coated with spaced strips of paint.

After the front panel has been painted and when the paint spray guns 90*a* through 90*d* reach the boundary between the front panel and the engine hood, the turning motor 68 is energized. As a consequence, the swing arm 78 is turned about the turning shaft 74 in the direction of the arrow B by the gear 76 meshing with the gear 70 mounted on the shaft 68*a* of the motor 68. The paint spray guns 90*a* through 90*d* coupled to the swing arm 78 are now directed perpendicularly to the engine hood of the vehicle body 14. The upper painting mechanism 36 is caused to travel along the rail 35*a* by the transport motor 52 for painting the engine hood.

While the support plate 64 is vertically displaced by the lifting/lowering motor 60 along the upper surface of the vehicle body 14 and the swing arm 78 is turned by the turning motor 68, the entire upper surface of the vehicle body 14 is coated with strips of paint.

The side painting mechanisms 38, 40 are displaced along the rails 35*a*, 35*b* in spaced relation to the upper painting mechanism 36, and at the same time the cylinder 98 is actuated to displace the gun arm 124 in the direction of the arrow E or F, during which time paint is sprayed from the paint spray guns 128*a* through 128*d* to apply strips of paint coating to the side panels of the vehicle body 14.

Then, the guide bar 104 is displaced in the direction of the arrow A or D by the cylinder 108 in each of the side painting mechanisms 38, 40. The cylinders 130*a* through 130*c* are actuated to angularly position the paint spray guns 128*a* , 128*b*, 128*d*, after which the side painting mechanisms 38, 40 are displaced in the opposite direction along the rails 35*a*, 35*b*. Paint sprayed by the paint spray guns 128*a* through 128*d* is applied to uncoated strip areas of the side panels of the vehicle body 14. Therefore, the entire surfaces of the side panels of the vehicle body 14 are now coated.

In the upper painting mechanism 36, the cylinder 80 is actuated to displace the horizontal gun arm 86 in the direction of the arrow E or F. The upper painting mechanism 36 is then displaced along the rail 35*a* in the opposite direction, while at the same time paint is applied by the paint spray guns 90*a* through 90*d* to uncoated areas on the upper panel of the vehicle body 14. Thus, the entire outer surfaces of the vehicle body 14 are fully coated.

After the painting process as above is finished, the vehicle body 14 is transferred by the conveyor mechanism 24 to the fourth stage 10*d* where the vehicle body 14 is dried.

After the vehicle body 14 has been painted or before the vehicle body 14 is painted, the paint spray guns 90*a* through 90*d* and 128*a* through 128*d* are cleaned by the cleaning apparatus 12.

More specifically, as shown in FIG. 1, the upper paint spray gun cleaning mechanism 136 of the cleaning apparatus 12 is directed parallel to the rail 35*b* while vehicle bodies 14 are being painted, so that the cleaning mechanism 136 will not obstruct the vehicle body 14 as it is painted. For cleaning the paint spray guns 90*a* through 90*d*, the body 144 (FIG. 4) is displaced vertically upwardly by the cylinder 143, and thereafter the body 144 is horizontally turned by the rotatable drive source 145 until the rods 146*a*, 146*b* are positioned parallel to the horizontal gun arm 86, for thereby moving the cleaning tanks 148*a* through 148*d* to their prescribed position (see the two-dot-and-dash-line position in FIG. 1 and FIG. 4).

Then, the lifting/lowering motor 60 is driven to cause the ball screw 58 to displace the support plate 64 in the direction of the arrow A. The paint spray guns 90*a* through 90*d* are also displaced in the direction of the arrow A by the swing arm 78 supported by the support plate 64 to direct the nozzles 91*a* through 91*d* into the respective cleaning tanks 148*a* through 148*d*. At this time, as shown in FIG. 6, the nozzle 91*a* of the paint spray gun 90*a* enters the holes 162*a*, 162*b* of the flexible covers 160*a*, 160*b* attached to the base plate 150 of the cleaning tank 148*a*.

A solvent such as a thinner is supplied from the solvent source to the pipe 192, and air is supplied under pressure from the air source to the pipe 198. The solvent is now supplied from the pipe 192 via the pipes 188, 190*a* through 190*d* to the first port 182*a* of the cleaning gun 176 and the non-illustrated ports of the cleaning guns 168*a* through 168*d*. The air under pressure is supplied from the pipes 194, 196*a* through 196*d* to the second port 182*b* of the cleaning gun 176 and the other non-illustrated ports of the cleaning guns 168*a* through 168*d*.

As shown in FIG. 8, the solvent supplied to the first port 182*a* of the cleaning gun 176 is ejected out via the first passage 184*a* from the smaller-diameter first nozzle 186*a*, and the air supplied under pressure from the second port 182*b* to the second passage 184*b* is ejected out from the second nozzle 186*b*. The solvent and the air ejected from the nozzles 186*a*, 186*b*, respectively, are mixed with each other and applied to the nozzle 91*a* of the paint spray gun 90*a* for cleaning the nozzle 91*a*. The nozzle ends 170*a* through 170*d* of the cleaning guns 168*a* through 168*d* also eject the mixture of the solvent such as a thinner and the air to clean the nozzle 91*a* of the paint spray gun 90*a* to which the nozzle ends 170*a* through 170*d* are directed.

While the nozzle 91*a* of the paint spray gun 90*a* is being cleaned, a paint solution containing the fluid ejected from the cleaning guns 168*a* through 168*d* and 176, i.e., a mixture of a drain solution and a mist is discharged through the outlet 210 at the lower end of the casing 200 and also through the conduits 212, 214 into the separation tank 216 where the mixture is separated into the drain and the mist. The mist is fed via the conduit 218 into a mist processing unit (not shown), and the drain is delivered by the pump 222 into a drain processing unit (not shown). Therefore, no drain/mist flows into the working space, and a good environment is maintained in the working space.

While the cleaning process for the paint spray gun 90*a* has been described in detail, the other paint spray guns 90*b* through 90*d* are cleaned in the same manner.

The paint spray guns 128*a* through 128*d* of the side painting mechanisms 38, 40 are cleaned as follows:

In the side paint spray gun cleaning device 138, the cylinders 232*a*, 232*b* (FIG. 4) are operated to displace the piston rods 234*a*, 234*b* horizontally to position the cleaning tanks 230*a*, 230*c* supported on the piston rods 234*a*, 234*b* in horizontal alignment with the respective paint spray guns 128*a*, 128*c*. The nozzle ends of the paint spray guns 128*a*, 128*b*, 128*d* are horizontally oriented and positioned (as indicated by the two-dot-and-dash lines in FIG. 3) by the holders 134*a* through 134*c* actuate by the cylinders 130*a* through 130*c*. The cylinder 116 is actuated to displace the rack 118 in a prescribed direction to cause the pinion 114 meshing with the rack 118 to turn the guide bar 104 through 90°. The gun arm 124 coupled to the guide bar 104 is swung from the side of the vehicle body 14 toward the side paint spray gun cleaning device 138 until the paint spray guns 128*a* through 128*d* confront the cleaning tanks 230*a* through 230*d*, respectively.

The lefthand side painting mechanism 38 is then displaced along the rail 35*a* toward the cleaning mechanism 138, whereupon the nozzle ends of the paint spray guns 128*a* through 128*d* are inserted into the respective cleaning tanks 230*a* through 230*d*. The nozzle ends of the paint spray guns 128*a* through 128*d* are now cleaned in the cleaning tanks 230*a* through 230*d* in the same manner as that in which the paint spray gun 90*a* is cleaned in the cleaning tank 148*a*.

The paint spray guns 128*a* through 128*d* of the right-hand side painting mechanism 40 are similarly automatically cleaned by the side paint spray gun cleaning mechanism 140.

With the aforesaid embodiment of the present invention, the upper paint spray gun cleaning mechanism 136 for cleaning the paint spray guns 90*a* through 90*d* of the upper painting mechanism 36 is angularly and vertically movable. When the vehicle body 14 is coated by the paint spray guns 90*a* through 90*d*, the upper paint spray gun cleaning mechanism 136 is retracted from the feed path of the vehicle body 14 to avoid interference with the paint coating operation. In a cleaning process, the cleaning tanks 148*a* through 148*d* are brought into a position suitable for cleaning the paint spray guns 90*a* through 90*d*. Therefore, it is possible to reduce the space which is taken up by the cleaning mechanism 136 on the painting line 10. The cleaning mechanism 136 can automatically and simultaneously clean the paint spray guns 90*a* through 90*d* in a reduced period of time. Since the cleaning process is automatically performed, the worker is subject to less of a burden than would be if the paint spray guns 90*a* through 90*d* were manually cleaned by the worker using a brush, and the entire painting process is automatized.

It can readily be understood that the paint spray guns 128*a* throuh 128*d* can simultaneously and efficiently be cleaned by the side paint spray gun cleaning mechanisms 138, 140.

As a consequence, the painting apparatus 34 with many paint spray gun 90*a* through 90*d* and 128*a* through 128*d* can be cleaned in a much shorter period of time than could be if each of the paint spray guns were manually cleaned, and the overall painting process can be effected highly efficiently.

The paint spray guns 90*a* through 90*d* to be cleaned can reliably be brought into the respective cleaning tanks 148*a* through 148*d*. When the paint spray guns 90*a* through 90*d* are cleaned, the solvent such as a thinner is prevented from leaking out of the cleaning tanks 148*a* through 148*d*. More specifically, the flexible cover members 160*a*, 160*b* have holes 162*a*, 162*b* and slits 164*a*, 164*b* communicating with the holes 162*a*, 162*b*, respectively. Even if the paint spray gun 90*a* is displaced out of a desired position when the swing arm 78 is displaced downwardly, the nozzle 91*a* of the paint spray gun 90*a* enters the holes 162*a* , 162*b* while spreading the slits 164*a*, 164*b*. The nozzle 91*a* of the paint spray gun 90*a* is thus prevented from hitting and being damaged by the casing 200 which is hard, and can reliably be inserted into the chamber 208 in the casing 148*a* through the holes 162*a*, 162*b* and the slits 164*a*, 164*b*.

The nozzle 91*a* enters the chamber 208 while spreading the slits 164*a*, 164*b* and the holes 162*a*, 162*b* smaller in diameter than the nozzle 91*a*. Since the slits 164*a*, 164*b* are defined out of alignment or do not overlap each other, an upper portion of the chamber 208 in the casing 200 can be completely closed by the nozzle 91*a* having entered the casing 200 and the flexible cover members 160*a*, 160*b*. As a result, the solvent sprayed from the cleaning guns 168*a* through 168*d*, 176 does not leak out of the chamber 208, and the drain and mist in the chamber 208 are reliably discharged via the outlet 210 into the separation tank 216. Inasmuch as the solvent such as a thinner ejected to clean the nozzle 91*a* does not leak into the working space, the thinner will not be inhaled by the workers and hence will not adversely affect the health of the workers. The working space is thus kept in a good working environment.

The cleaning guns 168*a* through 168*d*, 176 can easily be angularly adjusted with respect to the nozzle 91*a* of the paint spray gun 90*a*. More specifically, the cleaning guns 168*a* through 168*d*, 176 are mounted on the base plate 150, and the pipe 192 for supplying a solvent such as a thinner to the cleaning guns 168*a* through 16*d*, 176 and the pipe 198 for supplying air under pressure to the cleaning guns 168*a* through 168*d*, 176 are inserted through the holes 158*a*, 158*b* of the base plate 150. The casing 200 is detachably mounted on the base plate 150 through the bolts 202*a* through 202*d*.

By loosening the bolts 202*a* through 202*d* and detaching the casing 200 from the base plate 150, the cleaning guns 168*a* through 168*d*, 176 are exposed. Then, while the nozzle 91*a* of the paint spray gun 90*a* is being inserted in the holes 162*a*, 162*b* of the flexible cover members 160*a*, 160*b*; as shown in FIG. 6, the cleaning guns 168*a* through 168*d* can positionally be adjusted with respect to the nozzle 91*a*.

Because the casing 200 can independently be dismounted from the base plate 150, various operations such as angular adjustments of the cleaning guns 168*a* through 168*d* with respect to the nozzle 91*a* of the paint spray gun 90*a* can be effected with utmost ease. Consequently, the cleaning operation in the cleaning apparatus 12 can be carried out much more efficiently and reliably than the conventional cleaning apparatus.

Since the cleaning guns 168*a* through 168*d*, 176 can be exposed by removing the casing 200 from the base plate 150, the cleaning guns 168*a* through 668*d*, 176 can easily be inspected or otherwise serviced.

The cleaning guns 168*a* through 168*d*, 176 in the cleaning tank 148*a* are connected to the solvent supplying pipes 190*a* through 190*d*, 188 and the air supplying pipes 196*a* through 196*d* , 194, and the solvent and the air are ejected independently of each other from the nozzle ends 170*a* through 170*d*, 180, and mixed together and supplied to the nozzle 91*a* of the paint spray gun 90*a*. More specifically, as shown in FIG. 8, the solvent supplied from the first port 182*a* is ejected via the first passage 184*a* from the first nozzle 186*a*, and the air under pressure is ejected via the second port 182*b* and the second passage 184*b* from the second nozzle 186*b*. Therefore, the solvent and the air under pressure are mixed just out of the nozzle end 180 of the cleaning gun 176. The mixed fluid can thus forcibly be applied to the nozzle 91*a* under the combined forces with which the solvent and the air are ejected. The ejecting force for the mixed fluid is much larger than would be if a solvent such as a thinner were singly ejected toward the nozzle 91*a*, so that any paint deposit on the nozzle 91*a* can easily be blown off or removed. Since the air under pressure is also ejected together with the solvent, the amount of solvent used in the cleaning operation can be relatively small, and hence the solvent can efficiently be utilized.

Accordingly, the painting apparatus 34 with many paint spray guns 90*a* through 90*d* and 128*a* through 128*d* can be cleaned in a greatly reduced interval of time, and the cleaning process is made highly economical.

Figure 9:
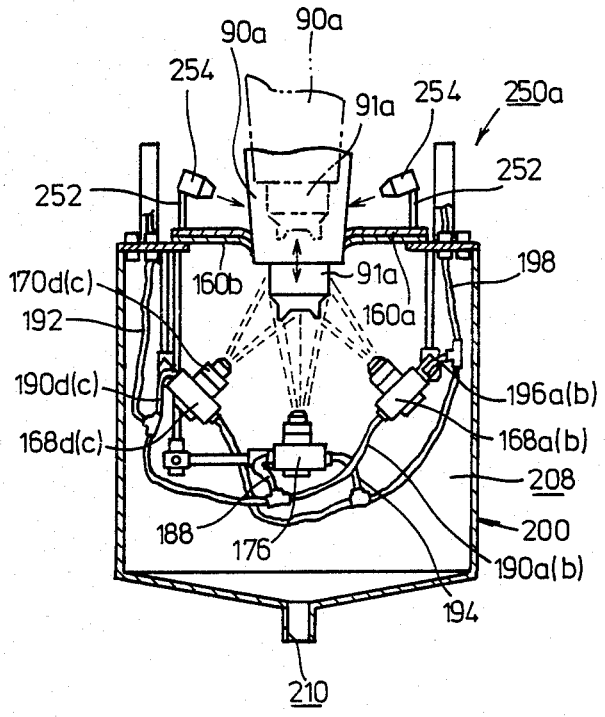
FIG. 9 is a vertical cross-sectional view of a cleaning tank of a cleaning apparatus according to another embodiment of the present invention.

FIG. 9 shows a cleaning apparatus according to another embodiment of the present invention. The parts in FIG. 9 which are identical to those of the cleaning tank 148*a* of the cleaning apparatus 12 according to the first embodiment shown in FIG. 6 are denoted by identical reference numerals, and will not be described in detail.

The cleaning apparatus of the second embodiment includes a cleaning tank 250*a* which has a plurality of support bars 252 vertically mounted on the surface of the base plate 150 on which the support members 152*a* through 152*d* are also supported, the support bars 252 being disposed around the opening 154 at equally spaced angular intervals. Air-blow nozzles 254 are mounted respectively on the support bars 252. The nozzles 254 have tip ends directed toward the central axis of the opening 154 and inclined toward the opening 154.

The cleaning apparatus of the second embodiment comprises an upper paint spray gun cleaning mechanism including, in addition to the cleaning tank 250*a*, three cleaning tanks (not shown) corresponding to the cleaning tanks 148*b* through 148*d* shown in FIG. 4, and side paint spray gun cleaning mechanisms.

A process of cleaning the paint spray gun 90*a* in the cleaning tank 250*a* will be described below.

As described above with reference to the cleaning apparatus 12 of the first embodiment, the nozzle 91*a* of the paint spray gun 90*a* is brought into the cleaning tank 250*a* by actuating the swing arm 78 and other members. A solvent such as a thinner is supplied from a solvent source (not shown) to the pipe 192, and air is supplied under pressure from an air source (not shown) to the pipe 198. Therefore, the mixture of the solvent and the air is ejected from the nozzle ends 170*a* through 170*d*, 180 of the cleaning guns 168*a* through 168*d*, 176 to clean the nozzle 91*a* of the paint spray gun 90*a* to which the nozzle ends 170*a* through 170*d* 180 are oriented. Then, the swing arm 78 is elevated to move the paint spray gun 90*a* out of the cleaning tank 250*a* (as shown by the two-dot-and-dash lines in FIG. 9). Air supplied under pressure via pipes (not shown) is then ejected from the nozzles 254 to blow off or evaporate remaining solvent deposits on the nozzle 91*a*, whereupon the cleaning process is finished.

The other paint spray guns 90*b* through 90*d* and 128*a* through 128*d* can be cleaned in the same manner as described above.

In the second embodiment, the paint spray guns 90*a* through 90*d* and 128*a* through 128*d* can automatically and reliably be cleaned so that neither paint nor solvent will remain deposited on these paint spray guns.

As described above with reference to FIG. 9, the cleaning guns 168*a* through 168*d*, 176 are disposed in the cleaning chamber 208 in the casing 200, and the air-blow nozzles 254 are positioned outside of the chamber 208. When the nozzle 91*a* of the paint spray gun 90*a* is inserted into the chamber 208 and the mixture of the solvent and the air is ejected from the cleaning guns 168*a* through 168*d*, 187 to clean the nozzle 91*a*, the solvent scattered in the chamber 208 or the paint attached to the nozzle 91*a* does not leak out of the chamber 208 because it is closed by the flexible cover members 160*a*, 160*b*. Therefore, neither solvent nor paint is applied to the nozzles 254. Then, the paint spray guns 90*a* are displaced out of the chamber 208, and air is ejected under pressure from the nozzles 254 to the nozzle 91*a* for scattering or evaporating any remaining solvent from the nozzle 91*a*. Accordingly, the cleaning process is effectively and reliably performed.

The nozzle 91*a* is thus reliably cleaned without leaving any remaining solvent or paint deposit thereon. When the vehicle body 14 is subsequently painted again by the paint spray gun 90*a* , therefore, a paint coat of desired color can well be applied to the vehicle body 14 without a painting failure or color mixture. The vehicle body 14 can therefore be painted accurately.

A cleaning apparatus according to still another embodiment of the present invention will be described with reference to FIGS. 10 and 11. The components which are identical to those of the first and second embodiments described above are designated by identical reference numerals, and will not be described in detail.

Figure 10:
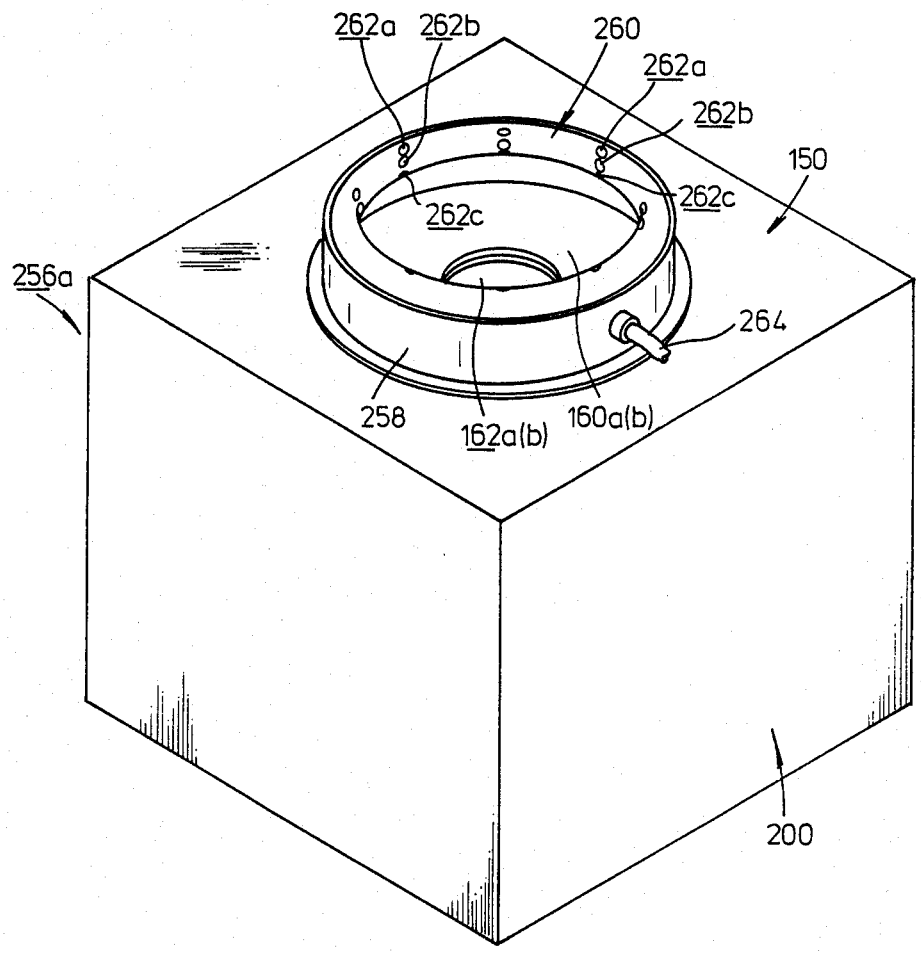
FIG. 10 is a perspective view of a cleaning tank of a cleaning apparatus according to still another embodiment of the present invention.
Figure 11:
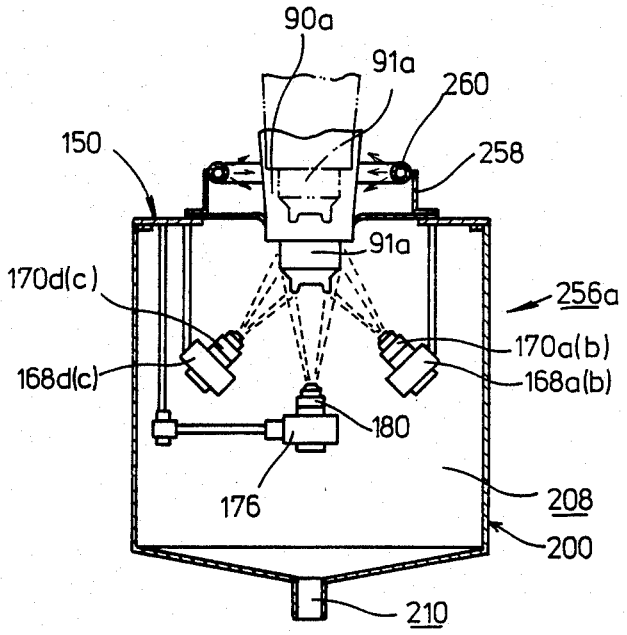
FIG. 11 is a vertical cross-sectional view of the cleaning tank shown in FIG. 10.

The cleaning apparatus shown in FIGS. 10 and 11 includes a cleaning tank 256*a* having a substantially cylindrical cover member 258 fixed to the base plate 150 and located outside of the chamber 208. An annular or ring-shaped pipe 260 for discharging air under pressure is attached to an outer end of the cover member 258. The discharge pipe 260 has a circumferential array of spaced holes 262*a* through 262*c* defined in its inner peripheral surface which defines a circular opening in the cover member 258. A pipe 264 for supplying air under pressure has one end connected to an outer peripheral surface of the discharge pipe 260 and the opposite end joined to a source (not shown) of air under pressure.

In operation, the mixture of the solvent and the air under pressure is ejected from the cleaning guns 168*a* through 168*d*, 176 toward the nozzle 91*a* of the paint spray gun 90*a* to remove paint deposits from the nozzle 91*a*. Thereafter, the paint spray gun 90*a* is moved out of the chamber 208. Then, air under pressure is supplied from the air source via the pipe 264 to the discharge pipe 260, from which the air is ejected via the holes 262*a* through 262*c* toward the center of the annular discharge pipe 260 in which the nozzle 91*a* is positioned as indicated by the two-dot-and-dash lines in FIG. 11. Therefore, any remaining solvent is evaporated or removed from the nozzle 91*a* by the applied air under pressure. The cleaning process is now completed. The solvent scattered from the nozzle 91*a* does not leak from the cover member 258, and hence the working space is kept in a good working environment.

Figure 12:
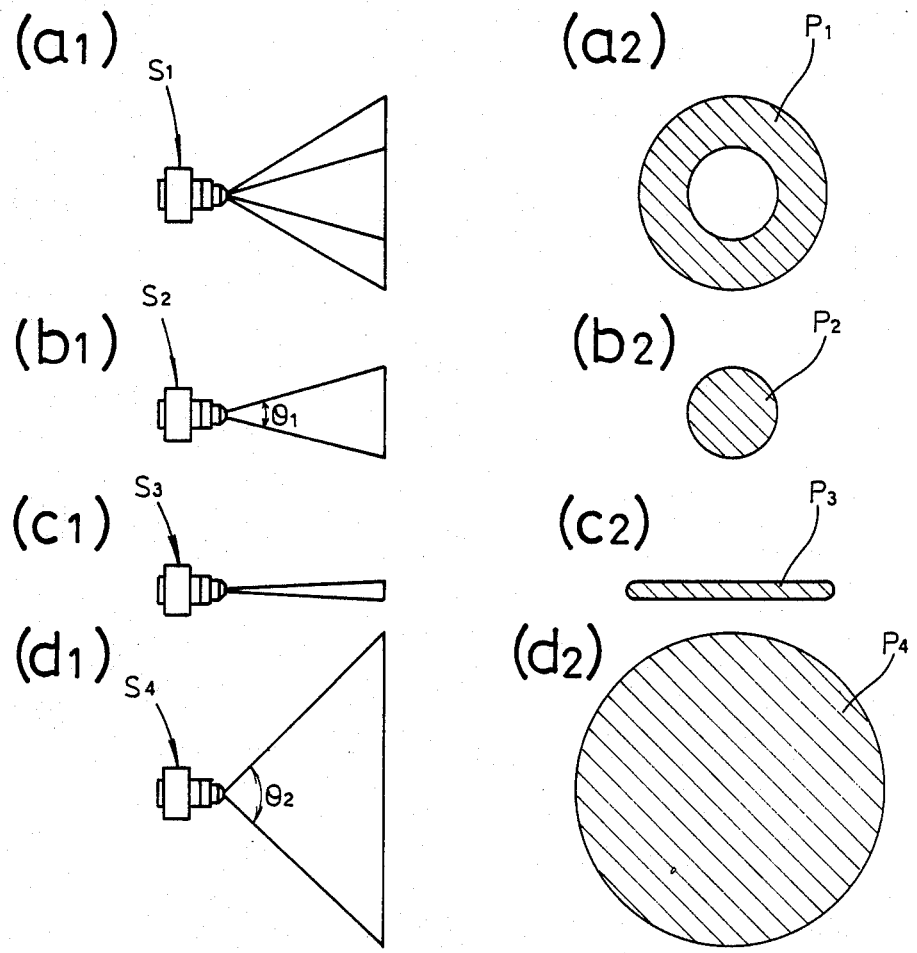
FIGS. 12($a_1$–$d_2$) shows cleaning guns and their spraying patterns in a cleaning apparatus according to a further embodiment of the present invention.
Figure 13D:
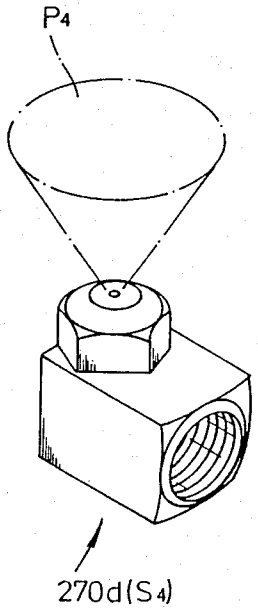
FIGS. 13(*a–d*) illustrates commercially available nozzles that can be used with the cleaning guns shown in FIG. 12.
Figure 13C:
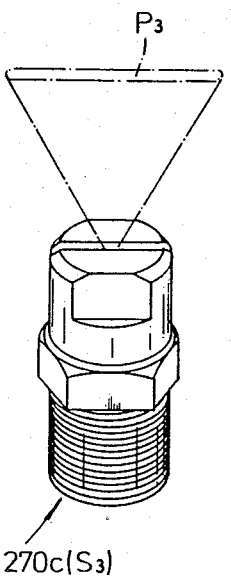
Figure 13B:
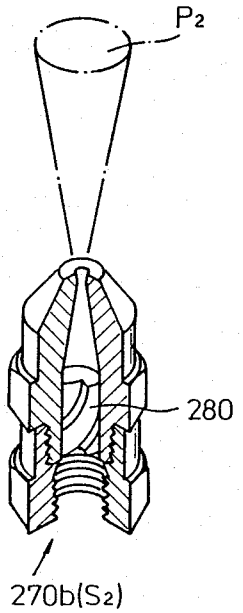
Figure 13A:
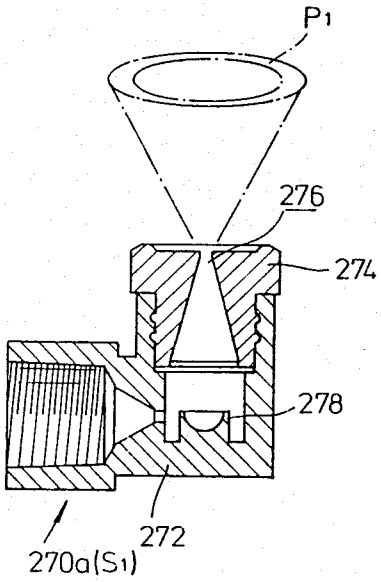

FIGS. 12 and 13 illustrate a cleaning apparatus according to a further embodiment of the present invention. In this fourth embodiment, one of various patterns in which a cleaning fluid is sprayed from the cleaning guns 168*a* through 168*d*, 176 is selected to meet the shape of the nozzle 91*a* of the paint spray gun 90*a* to be cleaned. Such spraying patterns are illustrated in FIG. 12.

FIG. 12 shows cleaning guns S1 through S4 at (a1) through (d1), respectively. Spraying patterns P1 through P4 for the cleaning fluid ejected from the cleaning guns S1 through S4 have respective shapes or configurations as shown in FIG. 12 at (a2) through (d2). More specifically, the spraying pattern P1 is doughnut-shaped, and the spraying patterns P2, P4 are of circular shapes of different diameters. The cleaning fluid is ejected from the cleaning gun S2 at a spraying angle $\theta 1$ in the range of from 10° to 30°, and the cleaning fluid is ejected from the cleaning gun S4 at a spraying angle $\theta 2$ in the range of from 30° to 60°. Therefore, the cleaning fluid sprayed from the cleaning gun S2 can be applied in a more concentrated manner and more forcibly than the cleaning fluid sprayed from the cleaning gun S4. The cleaning gun S2 may be used to clean an area where a larger amount of paint is deposited, and the cleaning gun S4 can spray the cleaning fluid in a wider area and may be used to clean an area where a relatively small amount of paint is deposited. The cleaning fluid is ejected from the cleaning gun S3 in a slit-like spraying pattern P3, and hence the cleaning gun S3 may be used to clean an area in which a linear paint deposit is attached.

Spray nozzles for the cleaning guns S1 through S4 may be selected from commercially available spray nozzles such as shown in FIG. 13 at (*a*) through (*d*). The spray nozzles of the type shown are sold by Spraying Systems, Japan K. K. and will briefly be described below.

The cleaning gun S1 is associated with a spray nozzle 270*a* which may be Whirl-Jet Nozzle B9360-1/4 AA-PP type. The spray nozzle 270*a* comprises a body 272 and a cap 274 detachably mounted on the body 272. The body 272 has a central post 278 coaxial with a nozzle member 276 of the cap 274. The spray nozzle 270*a* produces the spraying pattern P1 shown in FIG. 12 at (a2) and FIG. 13 at (a).

The cleaning gun S2 is associated with a spray nozzle 270*b* which may be one of Full-Jet Nozzle G, GG, H, HH types. The spray nozzle 270*b* that may be of the G type has an inner vane 280 removably disposed therein. The spray nozzle 270*b* produces the spraying pattern P2 shown in FIG. 12 at (b2) and FIG. 13 at (b). The cleaning guns S3, S4 are associated with a spray nozzle 270*c* which may be B-Jet Nozzle H-U type and a spray nozzle 270*d* which may be Full-Jet Nozzle GA type, respectively. The spray nozzles 270*c*, 270*d* generate the spraying pattern P3 shown in FIG. 12 at (c2) and FIG. 13 at (c), and the spraying pattern P4 shown in FIG. 12 at (d2) and FIG. 13 at (d).

For the cleaning guns 168*a*, 168*c* shown in FIGS. 5 through 7, the cleaning gun S2 for producing the smaller circular spraying pattern P2 is employed. The cleaning gun S3 for producing the slit-shaped spraying pattern P3 is used for the cleaning guns 168*b*, 168*d*. The cleaning gun S1 for producing the doughnut-shaped spraying pattern P1 is used for the cleaning gun 176.

If a paint spray gun 90*a* of a different shape is to be cleaned, one of the spraying patterns P1 through P4 for the cleaning solution ejected from the cleaning guns 168*a* through 168*d*, 176 may be selected to meet the shape of the paint spray gun 90*a*. The cleaning guns 168*a* through 168*d*, 176 may also be changed in their position.

In this embodiment, therefore, the mixture of the solvent and the air under pressure is ejected from the cleaning guns 168*a* through 168*d*, 176 in respective spraying patterns to the nozzle 91*a* of the paint spray gun 90*a*. Therefore, the nozzle 91*a* can be cleaned in a short period of time effectively with a small amount of solvent.

More specifically, since the front face of the nozzle 91*a* for ejecting paint is relatively easily contaminated with paint deposits, the cleaning gun S3 for producing the slit-like spraying pattern P1 is used as each of the cleaning guns 168*b*, 168*d* (see FIG. 6), and the cleaning gun S2 for generating the smaller circular spraying pattern P2 is used as each of the cleaning guns 168*a*, 168*c*. The cleaning gun S1 for generating the doughnut-shaped spraying pattern P3 is employed as the cleaning gun 176 which sprays the cleaning fluid on the central axis of the nozzle 91*a*. By thus spraying the cleaning fluid in a spraying pattern selected to meet the shape of an area which is relatively easily contaminated with paint deposits, the nozzle 91*a* can highly effectively be cleaned. If only the cleaning gun S2 for producing the small circular spraying pattern P2 were used for each of the cleaning guns 168*d*, 176, it would be time-consuming to clean the nozzle 91*a* and an excessive amount of cleaning fluid would be applied to those areas which are less contaminated with paint deposits, resulting in an undesirably large amount of thinner consumed.

According to this embodiment, as described above, the spraying patterns P1, P2, P3 are selected from the patterns P1 through P4 dependent on the shape of the nozzle 91*a* to be cleaned. Thus, the nozzle 91*a* can highly efficiently be cleaned. As no excessive solvent is applied to undesired areas, the amount of solvent used is reduced.

A method of cleaning the pipes for supplying paint to the paint spray guns 90*a* through 90*d* and 128*a* through 128*d* will hereinafter be described in detail.

Figure 14:
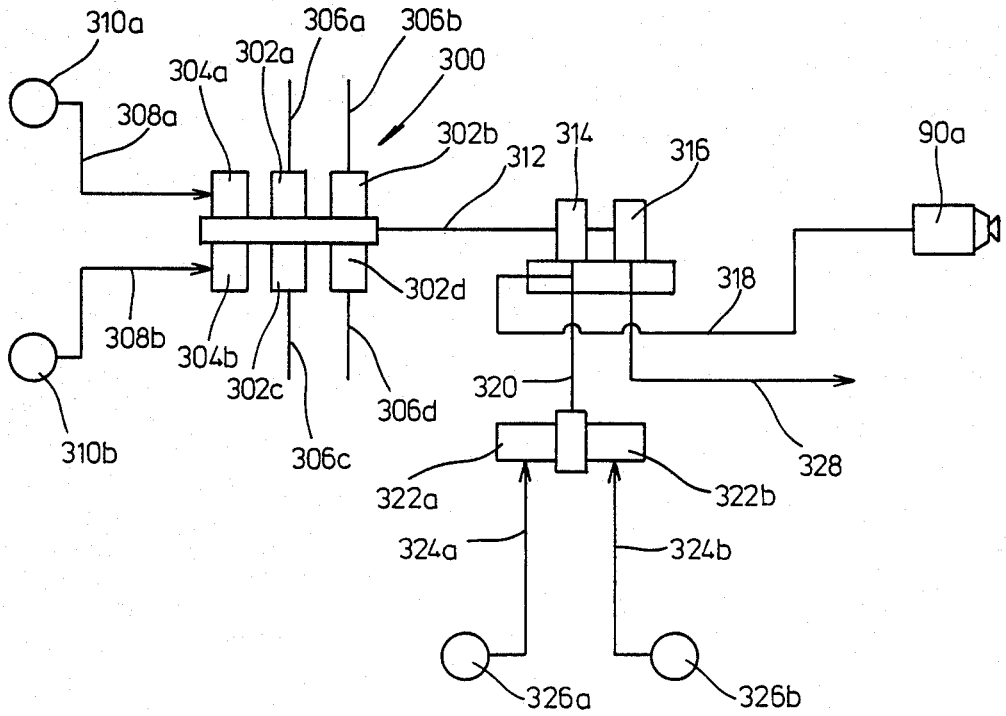
FIG. 14 is a diagram of a piping arrangement for carrying out a cleaning method according to the present invention.

FIG. 14 shows a piping arrangement for the paint spray guns 90*a* through 90*d* and 128*a* through 128*d*. The paint spray guns 90*a* through 90*d* and 128*a* through 128*d* are identical in construction to each other. Therefore, only the piping arrangement for the paint spray gun 90*a* will be described, and those for the other paint spray guns 90*b* through 90*d* and 128*a* through 128*d* will not be described.

Paint changeover means 300 comprises changeover valves 302*a* through 302*d* and 304*a*, 304*b*. To the changeover valves 302*a* through 302*d*, there are connected ends of pipes 306*a* through 306*d*, respectively, which have other ends joined to respective paint sources (not shown). The changeover valves 304*a*, 304*b* are connected to ends of pipes 308*a*, 308*b*, respectively, with their other ends coupled to respective regulators 310*a*, 310*b*. The regulator 310*a* is coupled to a cleaning solvent source (not shown) for supplying a thinner, for example, while the other regulator 310*b* is coupled to a pressurized air source (not shown).

The paint changeover means 300 is connected to a first pipe 312 joined to a paint spray valve 314 and a discharge valve 316. The paint spray valve 314 is coupled to a paint supplying second pipe 318 to which the paint spray gun 90*a* is connected. The paint spray valve 314 is connected via a pipe 320 to changeover valves 322*a*, 322*b* coupled to respective pipes 324*a*, 324*b*. The pipe 324*a* is connected to a regulator 326*a* which is coupled to a thinner source (not shown).

The other pipe 324*b* is also connected to a regulator 326*b* coupled to a pressurized air source (not shown). The discharge valve 316 is connected to one end of a pipe 328 which communicates with a drain processing unit (not shown).

After a vehicle body 14 has been painted on the painting line 10 or when a vehicle body 14 is to be painted with a different paint coat, the painting apparatus 12 is cleaned by a method of the present invention.

The paint changeover means 300 is actuated to disconnect the pipes 306*a* through 306*d* from the first pipe 312, and air under a prescribed pressure is supplied from the regulator 310*b* to the pipe 108*b*. The air under pressure is now supplied by the changeover valve 304*b* to the first pipe 312. The air flowing through the first pipe 312 is discharged out of the pipe 328 via the discharge valve 316.

Then, upon elapse of a predetermined period of time, the changeover valve 304*a* is actuated to supply a thinner under a prescribed pressure from the pipe 308*a* to the first pipe 312. Therefore, the thinner and the air are mixed in the first pipe 312, and air bubbles are produced in the mixture of the thinner and the air under pressure. When the air bubbles hit and are broken by paint deposits in the first pipe 312, the paint deposits are dissolved and removed from the inner wall surface of the first pipe 312 under impact forces applied when the air bubbles are broken.

Upon elapse of a further period of time, the changeover valve 304*a* is actuated again to stop supplying the thinner and allow only the air under pressure to be supplied to the first pipe 312. The dissolved paint in the first pipe 312 is now discharged out of the pipe 328 by the discharge valve 316.

When the first pipe 312 is cleaned, the second pipe 318 starts being cleaned.

The changeover valve 322*b* is actuated to supply air under pressure from the regulator 326*b* via the pipe 324*b* to the pipe 320 and the second pipe 318. The air under pressure is then discharged via the second pipe 318 from the paint spray gun 90*a*.

When a given period of time elapses, the changeover valve 322*a* is actuated to deliver a thinner under a prescribed pressure from the regulator 326*a* via the pipe 324*a* to the pipe 320. The thinner is now mixed with the air under pressure in the pipe 320 and flows with the air through the second pipe 318. Paint deposits in the second pipe 318 are dissolved and removed, and then ejected out of the paint spray gun 90*a*.

The changeover valve 322*a* is actuated again to stop supplying the thinner to the second pipe 318, whereupon only the air under pressure passes through the second pipe 318. The paint dissolved in the second pipe 318 is effectively purged from the paint spray gun 90*a* under the air pressure.

After the first and second pipes 312, 318 have been cleaned, the changeover valves 304*a*, 304*b* and 322*a*, 322*b* are actuated to disconnect the pipes 308*a*, 308*b* and 324*a*, 324*b* from the pipes 312, 318. One of the changeover valves 302*a* through 302*d*, e.g., the changeover valve 302*b* connected to the pipe 306*b* is actuated to feed paint from the pipe 306*b* to the pipes 312, 318, from which the paint is sprayed via the paint spray gun 90*a* to paint a vehicle body.

The piping arrangements connected to the other paint spray guns 90*b* through 90*d* and 128*a* through 128*d* can also be cleaned in the same manner as described above.

In the arrangement shown in FIG. 14, the pipes 312, 318 can be cleaned more efficiently in a shorter period of time than heretofore, and can be cleaned with a reduced amount of thinner.

Figure 15A:
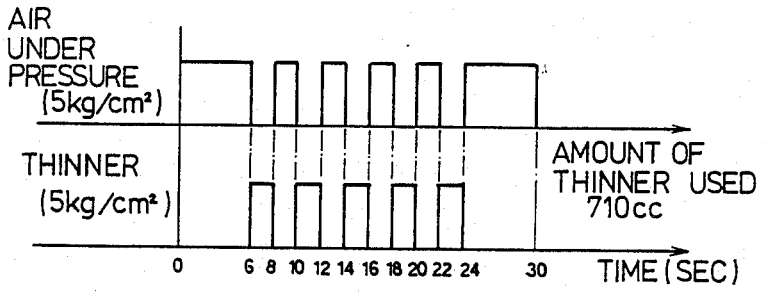
FIGS. 15(*a–b*) and 16(*a–b*) are illustrative of the relationship between the time during which a thinner and air under pressure are ejected in a conventional cleaning method and a cleaning method of the invention.
Figure 15B:
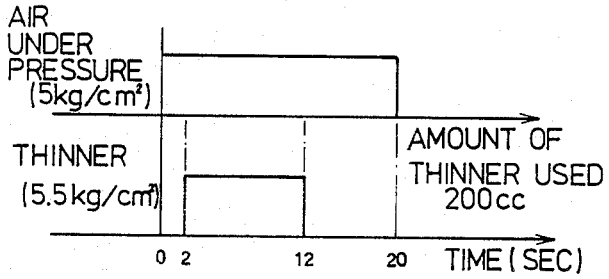
Figure 16A:
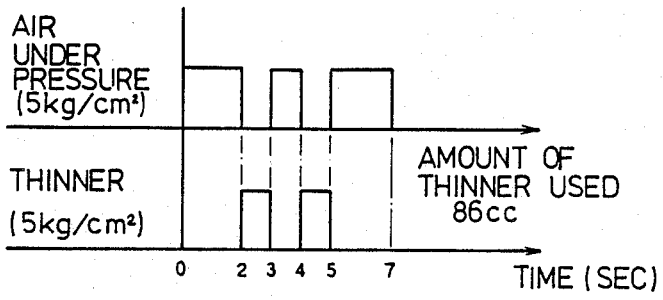
Figure 16B:
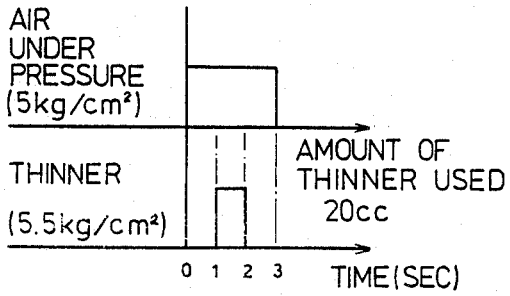

FIGS. 15 and 16 show times required for cleaning the first and second pipes 312, 318 according to a conventional method and the method of the present invention.

FIG. 15(*a*) is illustrative of a conventional cleaning method. Air used in the cleaning method is supplied under a pressure of 5 kg/cm$^2$, and a thinner is supplied under a pressure of 5 kg/cm$^2$. The air and the thinner are alternately supplied to the first pipe 312 to clean the interior thereof. According to the conventional method, about 30 seconds are required to clean the first pipe 312, and 710 cc of the thinner is used.

FIG. 15(*b*) shows a cleaning method according to the present invention. Air is supplied under a pressure of 5 kg/cm$^2$, and a thinner is supplied under a pressure of 5.5 kg/cm$^2$. As is apparent from FIG. 15(*b*), the pipe 312 is cleaned in about 20 seconds, and the amount of thinner used is 200 cc. The time required and the amount of thinner used in the inventive method are much smaller than those of the conventional method of FIG. 15(*a*).

In the conventional method, paint deposits in the first pipe 312 are dissolved by the thinner and then the dissolved paint is discharged by the air under pressure. With the invention of the present invention, however, the mixture of the thinner and the air is supplied to the first pipe 312 to produce air bubbles in the mixture, and paint deposits in the first pipe 312 are effectively removed by impact forces produced when the air bubbles are broken upon hitting the paint deposits. Therefore, the pipe 312 can be cleaned in a short period of time. The cleaning operation for the painting apparatus 34 having many paint spray guns 90*a* through 90*d* and 128*a* through 128*d* can thus be shortened. Since the amount of thinner used for the cleaning operation is reduced, the cleaning process is highly economical.

FIGS. 16(*a*) and (*b*) show times required for cleaning the second pipe 318 according to a conventional method and a method of the present invention. In the conventional method (FIG. 16(*a*)), air is supplied under a pressure of 5 kg/cm$^2$ and a thinner is supplied under a pressure of 5 kg/cm$^2$. In the method of the invention (FIG. 16(*b*)), air is supplied under a pressure of 5 kg/cm$^2$ and a thinner is supplied under a pressure of 5.5 kg/cm$^2$.

According to the conventional cleaning method, 7 seconds are required to clean the pipe 318 and 86 cc of thinner is used. In the inventive method, the time for cleaning the pipe 318 is 3 seconds, and the amount of thinner used is 20 cc. Therefore, the time and the amount of thinner used in the method of the invention are much smaller than those in the conventional method.

With the present invention, as described above, the paint spray guns of the painting apparatus for automatically painting the upper and side portions of an object are automatically cleaned by the cleaning tanks housing cleaning nozzles and displaceable in various directions. Therefore, the cleaning apparatus can be disposed closely to the mechanism for conveying the object to be painted, and the painting line system including the cleaning apparatus may be reduced in size. Since a plurality of paint spray guns can be cleaned simultaneously, the time required for cleaning those paint spray guns is much shorter than would be if the paint spray guns were cleaned one by one manually by the worker or a conventional cleaning apparatus, and hence the entire cleaning process can be effected efficiently. As the painting process and the process of cleaning the paint spray guns are automatically carried out, the combined painting and cleaning procedure can be performed fully automatically.

The two flexible cover members are mounted on the cleaning tank accommodating the cleaning guns therein, and the cover members have holes smaller in diameter than the nozzle of the paint spray gun to be cleaned which is inserted into the cleaning tank, the cover members also having slits communicating with the holes and defined so as not to overlap each other. Even if the paint spray gun is positionally displaced with respect to the cleaning tank when the paint spray gun is brought into the cleaning tank, the paint spray gun can reliably be placed in the cleaning tank without being damaged thereby because of the slits which can easily be spread by contact with the paint spray gun. When the paint spray gun is moved into the cleaning tank, the cover members and the paint spray gun cooperate with each other in closing the cleaning tank, and the solvent sprayed from the cleaning guns is prevented from leaking out of the cleaning tank into the working space, and hence can be led to the separation tank. Therefore, the health of the workers around the cleaning apparatus is not adversely affected by the solvent which would otherwise leak out, and the working space is kept in a good working environment.

The cleaning guns are mounted on the base plate of the cleaning tank, and the pipes connected to the cleaning guns are passed through and held by the base plate. The casing is detachably mounted on the base plate. By detaching the casing from the base plate, the cleaning guns as they are mounted on the base plate are exposed and can easily and accurately be adjusted in position with respect to the paint spray gun to be cleaned. Consequently, relative positional adjustments for the cleaning guns and the paint spray gun are facilitated, with the result that the entire cleaning process can be performed highly efficiently. The cleaning guns can easily be maintained, and the cleaning process can reliably be performed.

With the paint spray gun disposed in the cleaning tank, a solvent and air under pressure are separately ejected from the nozzles of the cleaning guns to apply the mixture of the solvent and the air to the paint spray gun for thereby cleaning the latter. The mixture fluid is forcibly applied with a considerable impact force to the paint spray gun under the combined forces with which the solvent and the air are ejected from the cleaning guns. This allows the paint spray gun to be cleaned efficiently within a short period of time. Since the air under pressure is mixed with the solvent, the solvent can economically be used for cleaning many paint spray guns. An automatic painting apparatus with a number of paint spray guns can efficiently be cleaned, and the amount of solvent used is reduced.

After the solvent has been ejected from the cleaning guns within the cleaning tank to clean the paint spray gun, air is ejected under pressure from the nozzles disposed outside of the cleaning tank to the paint spray gun which has been displaced out of the cleaning tank for thereby evaporating or removing any solvent deposits from the paint spray gun. When the paint spray gun is cleaned, the solvent sprayed from the cleaning gun or the paint deposited on the paint spray gun is not attached to the nozzles outside of the cleaning tank. Therefore, neither solvent nor paint is applied to the paint spray gun by the air under pressure ejected from the nozzles outside of the cleaning tank. The paint spray gun is thus automatically and reliably cleaned and can be used for a new painting process. The painting line system for carrying out the above painting process and cleaning process is thus fully automatized for an efficient painting operation.

When the cleaning fluid is ejected from the cleaning guns toward the paint spray gun inserted in the cleaning tank, the cleaning fluid is sprayed in suitable patterns from the cleaning guns which are selected to concentrate the cleaning fluid on an area of the paint spray gun which can relatively easily be contaminated with paint. Accordingly, the cleaning fluid is applied in a concentrated fashion to a portion of the paint spray gun which has a larger paint deposit, and thus such a portion can efficiently be cleaned within a short period of time. Moreover, since no excessive amount of solvent such as thinner is applied to an area which is less contaminated with paint, the amount of solvent used is reduced. Many paint spray guns of an automatic painting apparatus can thus be cleaned in a short interval of time and economically since they can be cleaned with a relatively small quantity of solvent.

When the pipes for supplying paint to the paint spray guns are to be cleaned, air is first supplied under pressure continuously to the pipes, and then the air and a solvent such as a thinner are passed through the pipes for a predetermined period of time for cleaning the interiors of the pipes. Therefore, the mixture of the air and the solvent, containing air bubbles, is caused to flow through the pipes. Paint deposits remaining in the pipes are dissolved and removed under impact forces produced when the air bubbles hit and are broken by the paint deposits, and are then discharged from the pipes. Consequently, the time required and the amount of solvent used to clean the interiors of the pipes are much smaller than those required and used heretofore. A painting apparatus having many paint spray guns can thus be cleaned within a greatly reduced period of time with a greatly reduced amount of solvent. The cleaning process for such a painting apparatus is therefore made quite economical and efficient.

Although certain preferred embodiments have been shown and described, it should be understood that many changes and modifications may be made therein without departing from the scope of the appended claims.

What is claimed is:

1. A method for automatically cleaning paint spray guns in a painting apparatus having an upper painting mechanism for painting an upper portion of an object fed along a painting line and a side painting mechanism for painting a side of the object, said method comprising the steps of:

displacing cleaning tanks for cleaning a plurality of paint spray guns of at least one of said painting mechanisms from a standby position to a cleaning position, each of said cleaning tanks having a plurality of cleaning nozzles therein;

relatively moving said cleaning tanks and said one painting mechanism to bring said paint spray guns into said cleaning tanks; and ejecting a cleaning fluid from said cleaning nozzles to clean said paint spray guns in said cleaning tanks.

2. A method according to claim 1, wherein said one painting mechanism is the upper painting mechanism.

3. A method according to claim 1, wherein side paint spray guns on said side painting mechanism are directed horizontally and the cleaning tanks for cleaning the side paint spray guns and said side painting mechanism are caused to confront each other, thereafter the side paint spray guns are brought into said cleaning tanks, and then a cleaning solution is ejected from the cleaning nozzles to clean said side paint spray guns.

4. An apparatus for cleaning paint spray guns, comprising:

a first cleaning mechanism for cleaning a plurality of paint spray guns mounted on an upper painting mechanism for cleaning an upper portion of an object;

a second cleaning mechanism for cleaning a plurality of paint spray guns mounted on a side painting mechanism for cleaning a side of the object;

each of said first and second cleaning mechanisms having as many cleaning tanks as the number of the paint spray guns and a plurality of cleaning nozzles in each of said cleaning tanks for ejecting a cleaning fluid;

said cleaning tanks of at least said first cleaning mechanism being displaceable between a standby position and a cleaning position, and retractable to said standby position to prevent said cleaning mechanism from interfering with painting operation when the object is painted by said painting mechanisms.

5. An apparatus according to claim 4, wherein the cleaning tanks of said first cleaning mechanism is displaceable between said standby position which is parallel to a direction in which said object is painted and said cleaning position which is normal to said direction and confronts the paint spray guns of said upper painting mechanism.

6. An apparatus according to claim 5, wherein said cleaning tanks of said first cleaning mechanism are vertically movable in unison.

7. An apparatus according to claim 4, wherein at least one of said cleaning tanks of said second cleaning mechanism is displaceable by an actuator in a direction normal to a direction in which the object is painted, said cleaning tanks being positionally adjustable so that the paint spray guns of said side painting mechanism confront said cleaning tanks when the side painting mechnism is angularly displaced to confront said second cleaning mechanism.

8. An apparatus according to claim 4, further including a separation tank connected to said cleaning tanks for separating a drain and a mist which are produced in said cleaning tanks.

9. An apparatus for cleaning a nozzle end of a paint spray gun, comprising:

a cleaning tank for receiving said nozzle end therein;

a plurality of cleaning nozzles disposed in said cleaning tank for ejecting a cleaning fluid to clean the nozzle end therein;

said cleaning tank including at least two flexible cover members for accommodating the nozzle en of said paint spray gun, each of said flexible cover members having a hole smaller in diameter than a portion of said paint spray gun which enters said cleaning tank, and a plurality of angularly spaced slits extending radially outwardly and communicating with said hole, said flexible cover members being held against each other with said slits not overlapping each other; and whereby when said paint spray gun is inserted into said holes, said paint spray gun and said cover members separate the interior and exterior of said cleaning tank from each other to prevent the cleaning fluid ejected by said cleaning nozzles from leaking out of said cleaning tank.

10. An apparatus according to claim 9, wherein said cover members are made of a resin material which is resistant to erosion by said cleaning fluid.

11. An apparatus for cleaning a nozzle end of a paint spray gun, comprising:

a cleaning tank for receiving said nozzle end therein;

a plurality of cleaning nozzles disposed in said cleaning tank for ejecting a cleaning fluid to clean the nozzle end therein;

said cleaning tank including a base plate and a casing detachably mounted on said base plate and defining a cleaning chamber therein, said cleaning nozzles being supported on said base plate; and pipes extending through said base plate for supplying said cleaning fluid to said cleaning nozzles.

12. An apparatus according to claim 11, wherein said cleaning tank further includes a flexible cover member attached to said base plate and having a hole for inserting said paint spray gun therein, whereby when said paint spray gun is inserted through said hole into said cleaning tank, said cover member and said paint spray gun isolates said cleaning chamber from the exterior of said cleaning tank, said casing having a passage for leading a drain and a mist produced in said cleaning chamber to a processing unit.

13. An apparatus for cleaning a nozzle end of a paint spray gun, comprising:

a cleaning tank for receiving at least said nozzle end therein;

a plurality of cleaning nozzles disposed in said cleaning tank for ejecting a cleaning fluid to clean the nozzle end therein; and said cleaning nozzle having a first passage for supplying a solvent and a second passage for supplying air, said cleaning nozzle being arranged to mix said solvent and air supplied from said first and second passages in a position just out of said cleaning nozzle and to eject the mixture as the cleaning fluid to said nozzle end of the paint spray gun.

14. An apparatus according to claim 13, wherein said cleaning nozzle includes a first nozzle for ejecting the solvent supplied from said first passage and a second nozzle disposed coaxially around said first nozzle for ejecting the air supplied from said second passage, whereby the mixture of the solvent ejected from said first nozzle and the air ejected from said second nozzle is applied to said nozzle end of the paint spray gun to clean said nozzle end.

15. An apparatus according to claim 13 or 14, wherein said cleaning nozzle is made of stainless steel.

16. A method of cleaning a paint spray gun, comprising the steps of:

inserting the paint spray gun in a cleaning tank housing a plurality of cleaning nozzles therein;

ejecting a solvent from said cleaning nozzles to clean said paint spray gun in said cleaning tank;

then, relatively displacing said paint spray gun and said cleaning tank away from each other; and thereafter, ejecting a fluid under pressure from fluid ejecting means mounted on and outside of said cleaning tank to dry said paint spray gun.

17. An apparatus for cleaning a nozzle end of a paint spray gun, comprising:

a cleaning tank for receiving at least said nozzle end therein;

a plurality of cleaning nozzles disposed in said cleaning tank for ejecting a solvent to said nozzle end to clean the nozzle end in said cleaning tank; and fluid ejecting means mounted on and outside of said cleaning tank for ejecting a fluid under pressure to said nozzle end to dry the nozzle end.

18. An apparatus according to claim 17, wherein said cleaning tank comprises a base plate and a casing, said base plate and said casing jointly defining a cleaning chamber therebetween, said cleaning nozzles being supported on a surface of said base plate which defines said cleaning chamber, said fluid ejecting means being mounted on the opposite surface of said base plate.

19. An apparatus according to claim 17 or 18, wherein said fluid ejecting means comprises a plurality of nozzles disposed around and directed toward said nozzle end of the paint spray gun for ejecting air as said fluid to said nozzle end of the paint spray gun.

20. An apparatus according to claim 17 or 18, wherein said fluid ejecting means comprises an annular tube having a plurality of holes defined in an inner peripheral surface thereof for ejecting therethrough air as said fluid to said nozzle end of the paint spray gun.

21. An apparatus according to claim 20, further including a substantially cylindrical cover member disposed between said base plate and said annular tube.

22. An apparatus for cleaning a paint spray gun, comprising:

a cleaning tank for receiving the paint spray gun;

a plurality of cleaning guns disposed in said cleaning tank and having nozzles for ejecting a cleaning fluid in different spraying patterns; and said cleaning guns being selectively actuatable for cleaning said paint spray guns dependent on the shape of an area to be cleaned of said paint spray gun which is received in said cleaning tank.

23. An apparatus according to claim 22, wherein said spraying patterns include at least a circular pattern, an annular pattern, and a slit-like pattern.

24. An apparatus according to claim 22 or 23, wherein said cleaning fluid comprises a mixture of air and a thinner.

25. A method of cleaning an interior of a pipe connected to a paint spray gun of a painting apparatus for supplying paint to the paint spray gun, comprising the steps of:

introducing air under pressure into said pipe; and then passing a cleaning solvent through said pipe during a prescribed period of time while the air is being introduced under pressure in said pipe for cleaning the interior of said pipe with a mixture of said solvent and said air under pressure.

26. A method according to claim 25, wherein said air under pressure and said solvent are supplied to said pipe in response to switching operation of a valve mechanism, the pressure of said solvent being higher than the pressure of said air.

27. A method according to claim 25 or 26, wherein said cleaning solvent to be mixed with said air under pressure is passed through said air to produce air bubbles in said cleaning solvent, whereby the interior of said pipe is cleaned by impact forces applied when said air bubbles are broken.

* * * * *